US006345467B1

(12) United States Patent
Weder

(10) Patent No.: US 6,345,467 B1
(45) **Date of Patent: *Feb. 12, 2002**

(54) FLORAL SLEEVE HAVING A DECORATIVE PATTERN

(75) Inventor: Donald E. Weder, Highland, IL (US)

(73) Assignee: Southpac Trust International, Inc., Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/464,742

(22) Filed: Dec. 16, 1999

Related U.S. Application Data

(63) Continuation-in-part of application No. 09/067,498, filed on Apr. 27, 1998, now Pat. No. 6,023,885.

(51) Int. Cl.[7] ..... A01G 9/02
(52) U.S. Cl. ..... 47/72; 229/87; 206/423
(58) Field of Search ..... 47/72; 206/423; 229/85, 55; 53/241

(56) References Cited

U.S. PATENT DOCUMENTS

| | | | | |
|---|---|---|---|---|
| 524,219 | A | 8/1894 | Schmidt | |
| 732,889 | A | 7/1903 | Paver | |
| 950,785 | A | 3/1910 | Pene | |
| 1,063,154 | A | 5/1913 | Bergen | |
| 1,446,563 | A | 2/1923 | Hughes | |
| 1,520,647 | A | 12/1924 | Hennigan | |
| 1,525,015 | A | 2/1925 | Weeks | |
| 1,610,652 | A | 12/1926 | Bouchard | |
| 1,697,751 | A | 1/1929 | Blake | 229/87 |
| 1,863,216 | A | 6/1932 | Wordingham | |
| 1,978,631 | A | 10/1934 | Herrlinger | 91/68 |
| 2,048,123 | A | 7/1936 | Howard | 229/87 |
| RE21,065 | E | 5/1939 | Copeman | 93/2 |
| 2,170,147 | A | 8/1939 | Lane | 206/56 |
| 2,200,111 | A | 5/1940 | Bensel | 229/1.5 |
| 2,278,673 | A | 4/1942 | Savada et al. | 154/43 |
| 2,302,259 | A | 11/1942 | Rothfuss | 41/10 |
| 2,323,287 | A | 7/1943 | Amberg | 229/53 |

(List continued on next page.)

FOREIGN PATENT DOCUMENTS

| | | |
|---|---|---|
| AU | 4231978 | 6/1979 |
| BE | 654427 | 1/1965 |
| CH | 560532 | 4/1975 |
| DE | 345464 | 12/1921 |
| DE | 513971 | 11/1930 |

(List continued on next page.)

OTHER PUBLICATIONS

Speed Cover Brochure, "The Simple Solution For Those Peak Volume Periods", Highland Supply Corporation, ©1989.
"Speed Sheets and Speed Rolls" Brochure, Highland Supply Corporation, ©1990.
"Color Them Happy with Highlander Products" ©1992.
"Costa Keeps the Christmas Spirit", Supermarket Floral, Sep. 15, 1992.
"Super Seller", Supermarket Floral, Sep. 15, 1992.

(List continued on next page.)

*Primary Examiner*—Charles T. Jordan
*Assistant Examiner*—Judith A. Nelson
(74) *Attorney, Agent, or Firm*—Dunlap, Codding & Rogers, P.C.

(57) ABSTRACT

A plant packaging and covering system including a floral sleeve having a decorative pattern thereon. The sleeve may have a lower portion sized to cover a pot and an upper portion which can surround a plant disposed in the pot and which can be detached once the protective function of the upper portion is complete or which can be used to support the sleeve from a support device prior to use. The decorative pattern preferably has a non-linear upper boundary which gives the sleeve the appearance of having a non-linear upper edge or skirt extending from the lower portion.

11 Claims, 11 Drawing Sheets

U.S. PATENT DOCUMENTS

| | | | | |
|---|---|---|---|---|
| 2,355,559 | A | 8/1944 | Renner | 229/8 |
| 2,371,985 | A | 3/1945 | Freiberg | 206/46 |
| 2,411,328 | A | 11/1946 | MacNab | 33/12 |
| 2,510,120 | A | 6/1950 | Leander | 117/122 |
| 2,529,060 | A | 11/1950 | Trillich | 117/68.5 |
| 2,621,142 | A | 12/1952 | Wetherell | 154/117 |
| 2,648,487 | A | 8/1953 | Linda | 229/55 |
| 2,688,354 | A | 9/1954 | Berger | 150/28 |
| 2,774,187 | A | 12/1956 | Smithers | 47/41 |
| 2,822,287 | A | 2/1958 | Avery | 117/14 |
| 2,846,060 | A | 8/1958 | Yount | 206/58 |
| 2,850,842 | A | 9/1958 | Eubank, Jr. | 47/58 |
| 2,883,262 | A | 4/1959 | Borin | 21/56 |
| 2,989,828 | A | 6/1961 | Warp | 53/390 |
| 3,022,605 | A | 2/1962 | Reynolds | 47/58 |
| 3,080,680 | A | 3/1963 | Reynold | 47/37 |
| 3,094,810 | A | 6/1963 | Kalpin | 47/37 |
| 3,121,647 | A | 2/1964 | Harris et al. | 118/202 |
| 3,130,113 | A | 4/1964 | Silman | 161/97 |
| 3,271,922 | A | 9/1966 | Wallerstein et al. | 53/3 |
| 3,322,325 | A | 5/1967 | Bush | 229/62 |
| 3,376,666 | A | 4/1968 | Leonard | 47/41 |
| 3,380,646 | A | 4/1968 | Doyen et al. | 229/57 |
| 3,431,706 | A | 3/1969 | Stuck | 53/390 |
| 3,508,372 | A | 4/1970 | Wallerstein et al. | 53/3 |
| 3,510,054 | A | 5/1970 | Sanni et al. | 229/66 |
| 3,512,700 | A | 5/1970 | Evans et al. | 229/53 |
| 3,552,059 | A | 1/1971 | Moore | 47/41.12 |
| 3,554,434 | A | 1/1971 | Anderson | 229/55 |
| 3,556,389 | A | 1/1971 | Gregoire | 229/53 |
| 3,557,516 | A | 1/1971 | Brandt | 53/14 |
| 3,620,366 | A | 11/1971 | Parkinson | 206/59 |
| 3,681,105 | A | 8/1972 | Milutin | 117/15 |
| 3,767,104 | A | 10/1973 | Bachman et al. | 229/7 |
| 3,793,799 | A | 2/1974 | Howe | 53/32 |
| 3,869,828 | A | 3/1975 | Matsumoto | 47/34.11 |
| 3,888,443 | A | 6/1975 | Flanigen | 248/152 |
| 3,962,503 | A | 6/1976 | Crawford | 428/40 |
| 4,043,077 | A | 8/1977 | Stonehocker | 47/66 |
| 4,054,697 | A | 10/1977 | Reed et al. | 428/40 |
| 4,091,925 | A | 5/1978 | Griffo et al. | 206/423 |
| 4,113,100 | A | 9/1978 | Soja et al. | 206/602 |
| 4,118,890 | A | 10/1978 | Shore | 47/28 |
| 4,189,868 | A | 2/1980 | Tymchuck et al. | 47/84 |
| 4,216,620 | A | 8/1980 | Weder et al. | 47/72 |
| 4,248,347 | A | 2/1981 | Trimbee | 206/423 |
| D259,333 | S | 5/1981 | Charbonneau | D9/306 |
| 4,265,049 | A | 5/1981 | Gorewitz | 47/26 |
| 4,280,314 | A | 7/1981 | Stuck | 53/241 |
| 4,297,811 | A | 11/1981 | Weder | 47/72 |
| 4,333,267 | A | 6/1982 | Witte | 47/84 |
| 4,347,686 | A | 9/1982 | Wood | 47/73 |
| 4,380,564 | A | 4/1983 | Cancio et al. | 428/167 |
| 4,400,910 | A | 8/1983 | Koudstall et al. | 47/84 |
| 4,413,725 | A | 11/1983 | Bruno et al. | 206/45.33 |
| D279,279 | S | 6/1985 | Wagner | D11/143 |
| 4,546,875 | A | 10/1985 | Zweber | 206/0.82 |
| 4,621,733 | A | 11/1986 | Harris | 206/423 |
| 4,640,079 | A | 2/1987 | Stuck | 53/390 |
| 4,717,262 | A | 1/1988 | Roen et al. | 383/120 |
| 4,733,521 | A | 3/1988 | Weder et al. | 53/580 |
| 4,765,464 | A | 8/1988 | Ristvedt | 206/0.82 |
| 4,771,573 | A | 9/1988 | Stengel | 47/67 |
| 4,773,182 | A | 9/1988 | Weder et al. | 47/72 |
| 4,801,014 | A | 1/1989 | Meadows | 206/423 |
| 4,810,109 | A | 3/1989 | Castel | 383/105 |
| 4,835,834 | A | 6/1989 | Weder | 29/525 |
| D301,991 | S | 7/1989 | Van Sant | D11/149 |
| 4,941,572 | A | 7/1990 | Harris | 206/423 |
| 4,980,209 | A | 12/1990 | Hill | 428/34.1 |
| 5,073,161 | A | 12/1991 | Weder et al. | 493/154 |
| 5,074,675 | A | 12/1991 | Osgood | 383/122 |
| 5,105,599 | A | 4/1992 | Weder | 53/399 |
| 5,111,638 | A | 5/1992 | Weder | 53/397 |
| 5,120,382 | A | 6/1992 | Weder | 156/212 |
| 5,152,100 | A | 10/1992 | Weder et al. | 47/72 |
| 5,181,364 | A | 1/1993 | Weder | 53/397 |
| D335,105 | S | 4/1993 | Ottenwalder et al. | D11/164 |
| 5,199,242 | A | 4/1993 | Weder et al. | 53/397 |
| 5,205,108 | A | 4/1993 | Weder et al. | 53/397 |
| 5,228,234 | A | 7/1993 | de Klerk et al. | 47/41.01 |
| 5,235,782 | A | 8/1993 | Landau | 47/72 |
| 5,239,775 | A | 8/1993 | Landau | 47/72 |
| 5,249,407 | A | 10/1993 | Stuck | 53/399 |
| 5,259,106 | A | 11/1993 | Weder et al. | 29/469.5 |
| 5,307,606 | A | 5/1994 | Weder | 53/410 |
| 5,315,785 | A | 5/1994 | Avôt et al. | 47/72 |
| 5,350,240 | A | 9/1994 | Billman et al. | 383/104 |
| 5,353,575 | A | 10/1994 | Stepanek | 53/461 |
| 5,361,482 | A | 11/1994 | Weder et al. | 29/469 |
| 5,388,695 | A | 2/1995 | Gilbert | 206/423 |
| 5,428,939 | A | 7/1995 | Weder et al. | 53/397 |
| 5,443,670 | A | 8/1995 | Landau | 156/191 |
| 5,493,809 | A | 2/1996 | Weder et al. | 47/72 |
| D368,025 | S | 3/1996 | Sekerak et al. | D9/305 |
| 5,496,251 | A | 3/1996 | Cheng | 493/224 |
| 5,496,252 | A | 3/1996 | Gilbert | 493/224 |
| 5,526,932 | A | 6/1996 | Weder | 206/423 |
| 5,572,849 | A | 11/1996 | Weder et al. | 53/399 |
| 5,572,851 | A | 11/1996 | Weder | 53/399 |
| 5,575,133 | A | 11/1996 | Weder et al. | 53/397 |
| 5,617,703 | A | 4/1997 | Weder | 53/413 |
| 5,624,320 | A | 4/1997 | Martinez | 472/51 |
| 5,647,168 | A | 7/1997 | Gilbert | 47/72 |
| 6,023,885 | A * | 2/2000 | Weder | 47/72 |

FOREIGN PATENT DOCUMENTS

| | | |
|---|---|---|
| DE | 1166692 | 3/1964 |
| DE | 1962947 | 6/1971 |
| DE | 2060812 | 11/1971 |
| DE | 2748626 | 5/1979 |
| DE | 3445799 | 6/1986 |
| DE | 3829281 | 5/1989 |
| DE | 3911847 | 10/1990 |
| EP | 0050990 | 5/1982 |
| EP | 0791543 | 8/1997 |
| FR | 1376047 | 9/1964 |
| FR | 2036163 | 12/1970 |
| FR | 2137325 | 12/1972 |
| FR | 2272914 | 12/1975 |
| FR | 2489126 | 3/1982 |
| FR | 2610604 | 8/1988 |
| FR | 2603159 | 3/1989 |
| FR | 2619698 | 3/1989 |
| GB | 5605 | of 1885 |
| GB | 1204647 | 9/1970 |
| GB | 2056410 | 3/1981 |
| GB | 2074542 | 11/1981 |
| GB | 2128083 | 4/1984 |
| GB | 2252708 | 8/1992 |
| IT | 224507 | 4/1996 |
| JP | 542958 | 2/1993 |
| NL | 8301709 | 12/1984 |
| NL | 1000658 | 1/1996 |
| WO | 9315979 | 8/1993 |

OTHER PUBLICATIONS

"Halloween", Link Magazine, Sep. 1992.

"Now More Than Ever", Supermarket Floral, Sep. 15, 1992.

Le Plant Sac Advertisement, published prior to 9/26/87.

"A World of Cut Flower and Pot Plant Packaging" Brochure, Klerk's Plastic Products Manufacturing, Inc., published prior to 3/31/94, 6 pages.
Chantler & Chantler brochure showing Zipper Sleeve™ and Florasheet®, published prior to 3/31/94, 2 pages.
"Foil Jackets" brochure, Custom Medallion, Inc., Dec., 1996, 2 pages.
"Derwent Abstract" of FR 2610604A. It is noted that the abstract is an incorrect English translation of the contents of the French patent. The French patent does not enable or disclose adhesively attaching the covering to the container. 1988.

"Silver Linings" Brochure, Affinity Diversified Industries, Inc., 1986. The Silver Linings brochure shows a floral sleeve with a closed bottom. The brochure shows , in one embodiment, a vase with flowers inside a "cut flower" sleeve with the sleeve tied with a ribbon about the neck of the vase.

* cited by examiner

FLORAL SLEEVE HAVING A DECORATIVE PATTERN

CROSS-REFERENCE TO RELATED APPLICATIONS

The present application is a continuation-in-part of U.S. Ser. No. 09/067,498 filed Apr. 27, 1998, now U.S. Pat. No. 6,023,885, issued Feb. 15, 2000, the specification of which is hereby incorporated by reference herein.

The present application has subject matter which is related to the disclosures of U.S. Pat. No. 5,625,979, and U.S. Pat. No. 5,572,851. The specifications of each of these patents are hereby incorporated by reference herein in their entirety.

FIELD OF THE INVENTION

This invention generally relates to sleeves, and, more particularly, sleeves used to wrap floral groupings or flower pots containing floral groupings and/or mediums containing floral groupings, and methods of using same.

DESCRIPTION OF THE PREFERRED EMBODIMENTS

Figure 1:
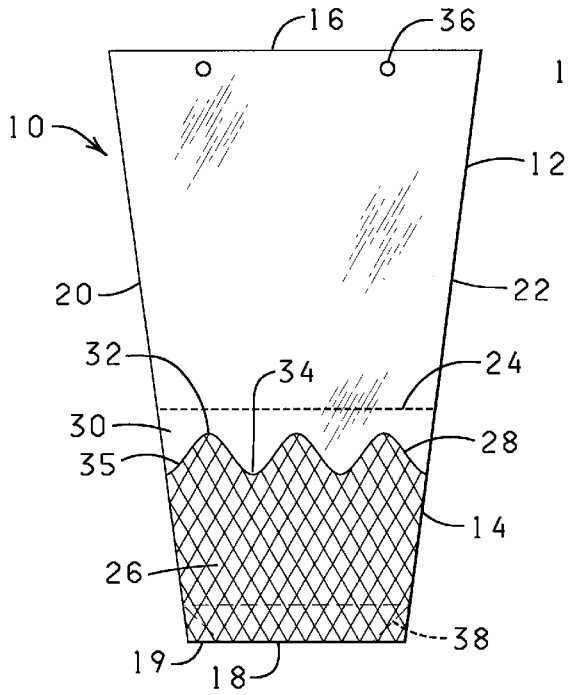
FIG. 1 is an elevational view of a sleeve having a base portion with a decorative pattern having a non-linear upper boundary and having an upper detachable portion constructed in accordance with the present invention.

The present invention contemplates in a preferred version a preformed tubular sleeve for covering a pot having an upper rim, a lower end, and an outer peripheral surface. The preformed tubular sleeve comprises a lower portion and may further comprise a detachable upper portion generally sized to surround and enclose a floral grouping. The upper portion when present may be detachable via perforations, tear strips, weakened areas, or zippers. The upper portion may have one or more apertures or an extended upper portion for serving as a handle or support device.

The preformed tubular sleeve (also referred to herein as a tubular sleeve or sleeve) may form part of a plant package when used in conjunction with a pot disposed within an inner retaining space of the lower portion of the tubular sleeve, the pot having a floral grouping disposed therein. The pot is substantially surrounded and encompassed by the lower portion and the floral grouping is substantially surrounded and encompassed and enclosed by the upper portion when it is present as a part of the tubular sleeve.

Also, the lower portion of the sleeve may include a bonding material disposed on an inner peripheral surface thereof for bondingly connecting to a pot disposed therein. The bonding material may optionally be disposed on an outer peripheral surface thereof.

The lower portion of the preformed tubular sleeve may be constructed from a first material and the upper portion (when present) constructed from a second material different from the first material.

The preformed tubular sleeve is initially formed in a flattened condition and may be expanded to an open condition at any time prior to use, shipment, or sale.

The sleeve may include vertical or horizontal expansion elements, preferably comprising a plurality of folds. The folds may extend entirely circumferentially about the lower portion, or may extend only partially circumferentially about the lower portion, or may extend into a skirt portion of the lower portion. The expansion elements preferably function to cause the lower portion to conform to the shape of a pot when a pot is disposed within the sleeve. The folds or expansion elements may extend the entire length from the lower end of the lower portion to the upper end of the sleeve or may extend only an intermediate distance therebetween.

The expansion elements may be a plurality of vertical pleats, a plurality of vertical folds each having a z-shaped cross section, a plurality of vertical accordion-type folds, or other similar types of expandable forms. Examples of such expansion elements are disclosed in U.S. Pat. No. 5,625,979, the specification of which was previously incorporated by reference herein in its entirety.

These embodiments and others of the present invention are now described in more detail below. It will be appreciated that the examples provided herein are not intended to limit the scope and extent of the claimed invention but are only intended to exemplify various of the embodiments of the invention contemplated herein.

The Embodiments and Methods of Use of FIG. 1–7

Figure 2:
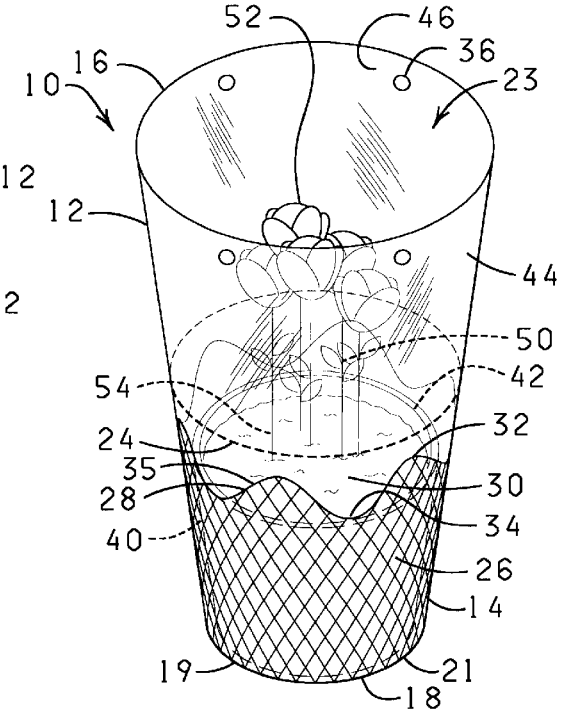
FIG. 2 is a perspective view of a potted plant disposed within the opened sleeve of FIG. 1.
Figure 3:
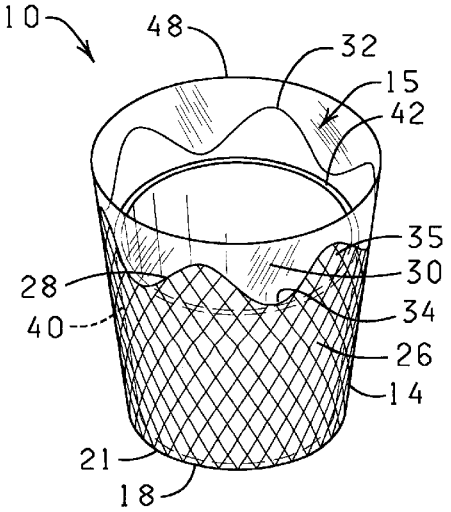
FIG. 3 is a perspective view of the sleeve of FIG. 1 and a pot after the upper portion of the sleeve has been removed from the lower portion of the sleeve.

Shown in FIGS. 1–3 and designated therein by the general reference numeral 10 is a flexible preformed tubular sleeve (also referred to herein as simply a "sleeve") of unitary construction. The sleeve 10 preferably initially comprises a flexible flat collapsed piece of material having a flattened condition which is openable in the form of a tube or sleeve having an open bottom, a closed bottom, or a closed bottom having drainage holes. Prior to shipment to the user, or prior to use by the user, the sleeve 10 may be formed in an opened frusto-conical configuration for example for shipment in a nested bunch. The sleeve 10 is preferably tapered outwardly from the lower end toward a larger diameter at its upper end. In its flattened state the sleeve 10 in a preferred embodiment has an overall trapezoidal or modified trapezoidal shape, and when opened is substantially frusto-conical. It will be appreciated, however, that the sleeve 10 may comprise variations on the aforementioned shapes as shown herein or may comprise significantly altered shapes such as square or rectangular, wherein the sleeve 10 when opened has a cylindrical form, as long as the sleeve 10 functions in accordance with the present invention in the manner described herein.

Figure 5:
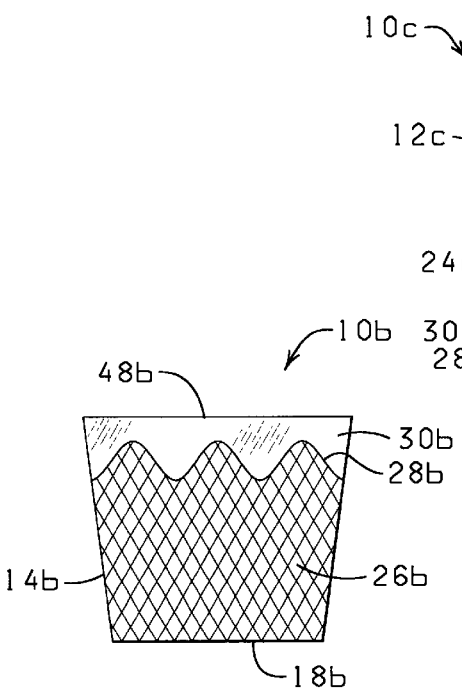
FIG. 5 is an elevational view of another sleeve constructed in accordance with the present invention.

The sleeve 10 in a particularly preferred version has an upper portion 12, a lower portion 14, an inner retaining space 15, an upper end 16, and a lower end 18, and in its flattened state has a first side 20 and a second side 22. The sleeve 10 has an opening 23 at the upper end 16 and is, in a preferred embodiment, closed with a bottom 19 at the lower end 18. The bottom 19 has a perimeter 21. A portion of the lower end 18 may have one or more gussets 38 therein constructed in a manner well known to one of ordinary skill in the art, as shown in FIG. 1 for permitting a bottom of an object such as a pot 40 to be disposed into an inner retaining space 15 of the lower portion 14 of the sleeve 10. Gussets 38, and the construction of gussets, are well known in the art of constructing flexible containers, therefore further discussion of gussets or their construction is not deemed necessary herein. Further, the lower end 18 may be constructed in the manner shown in copending U.S. Ser. No. 09/401,771, the specification of which is hereby incorporated herein in its entirety. FIG. 5, discussed in more detail hereinbelow, shows a sleeve **10*b* formed without a gusset in a lower end 18*b*** thereof.

The sleeve 10 is generally frusto-conically shaped, but the sleeve 10 may be, by way of example but not by way of limitation, cylindrical, frusto-conical, a combination of both frusto-conical and cylindrical, or any other shape, as long as the sleeve 10 functions as described herein as noted above. Further, the sleeve 10 may comprise any shape, whether geometric, non-geometric, symmetrical and/or fanciful as long is it functions in accordance with the present invention. The sleeve 10 may also be equipped with a drainage element (e.g., one or more holes) in the lower end 18 or ventilation holes (not shown) or can be made from permeable or impermeable materials.

The material from which the sleeve 10 is constructed preferably has a thickness in a range from about 0.1 mil to about 30 mils. Often, the thickness of the sleeve 10 is in a range from about 0.5 mil to about 10 mils. Preferably, the sleeve 10 has a thickness in a range from about 1.0 mil to about 5 mils. More preferably, the sleeve 10 is constructed from a material which is flexible, semi-rigid, rigid, or any combination thereof. The sleeve 10 may be constructed of a single layer of material or a plurality of layers of the same or different types of materials. Any thickness of the material may be utilized as long as the material functions in accordance with the present invention as described herein. The layers of material comprising the sleeve 10 may be connected together or laminated or may be separate layers. Such materials used to construct the sleeve 10 are described in U.S. Pat. No. 5,111,637, entitled "Method For Wrapping A Floral Grouping" issued to Weder et al., on May 12, 1992, which is hereby incorporated herein by reference. Any thickness of material may be utilized in accordance with the present invention as long as the sleeve 10 may be formed as described herein, and as long as the formed sleeve 10 may contain at least a portion of the pot 40 and/or potted plant or a floral grouping 50, as described herein. Additionally, an insulating material such as bubble film, preferably one of two or more layers, can be utilized in order to provide additional protection for the item, such as the floral grouping 50, contained therein.

In one embodiment, the sleeve 10 may be constructed from a sheet comprising two polypropylene films. The material comprising the sleeve 10 may be connected together or laminated or may be separate layers. In an alternative embodiment, the sleeve 10 may be constructed from only one of the polypropylene films.

The sleeve 10 is constructed from any suitable material that is capable of being formed into the sleeve 10 and wrapped about the pot 40 and the floral grouping 50 disposed therein. Preferably, the material comprises paper (untreated or treated in any manner), metal foil, polymeric film, non-polymeric film, fabric (woven or nonwoven or synthetic or natural), cardboard, fiber, cloth, burlap, or laminations or combinations thereof.

The term "polymeric film" means a man-made polymer such as a polypropylene or a naturally occurring polymer such as cellophane. A polymeric film is relatively strong and not as subject to tearing (substantially non-tearable), as might be the case with paper or foil.

The material used to construct the sleeve 10 may vary in color and may consist, for example, of designs or decorative patterns which are printed, etched, and/or embossed thereon using inks or other printing materials. An example of an ink which may be applied to the surface of the material is described in U.S. Pat. No. 5,147,706, entitled "Water Based Ink On Foil And/Or Synthetic Organic Polymer" issued to Kingman on Sep. 15, 1992, and which is hereby incorporated herein by reference.

In addition, the material used to construct the sleeve 10 may have various colorings, coatings, flocking and/or metallic finishes, or other decorative surface ornamentation applied separately or simultaneously or may be characterized totally or partially by pearlescent, translucent, transparent, iridescent, neon, or the like, qualities. The material may further comprise, or have applied thereto, one or more scents. Each of the above-named characteristics may occur alone or in combination and may be applied to the upper and/or lower surface of the material comprising the sleeve 10. Moreover, portions of the material used in constructing the sleeve 10 may vary in the combination of such characteristics. The material utilized for the sleeve 10 itself may be opaque, translucent, transparent, or partially clear or tinted transparent.

The term "floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping. The floral grouping comprises a bloom or foliage portion and a stem portion. Further, the floral grouping may comprise a growing potted plant having a root portion (not shown) as well. However, it will be appreciated that the floral grouping may consist of only a single bloom or only foliage, or a botanical item (not shown), or a propagule (not shown). The term "floral grouping" may be used interchangeably herein with both the terms "floral arrangement" and "potted plant". The term "floral grouping" may also be used interchangeably herein with the terms "botanical item" and/or "propagule."

The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquets or floral groupings.

The term "propagule" when used herein means any structure capable of being propagated or acting as an agent of reproduction including seeds, shoots, stems, runners, tubers, plants, leaves, roots or spores.

In accordance with the present invention, a bonding material (not shown) may be disposed on a portion of the sleeve 10 to assist in holding the sleeve 10 to the pot 40 having the floral grouping 50 therein when the pot 40 is disposed within the sleeve 10 or to assist in closing or sealing a portion of the sleeve 10, or in adhering the sleeve 10 to the pot 40 after the pot 40 has been disposed therein, as disclosed in U.S. Pat. Nos. 5,625,979 and 5,493,809, the specifications of which are hereby incorporated herein in their entirety.

As noted above, the sleeve 10 in one embodiment, is demarcated into the upper portion 12 and the lower portion 14. The lower portion 14 of the sleeve 10 is generally sized to contain the pot 40. The upper portion 12 of the sleeve 10 may be sized to substantially surround and enclose the floral grouping 50 contained within the pot 40 disposed within the lower portion 14 of the sleeve 10, or may surround and enclose only a portion of the floral grouping 50, as explained in more detail below. In a preferred embodiment, the sleeve 10 is demarcated into the upper portion 12 and the lower portion 14 by a detaching element 24, which may be a line of perforations for enabling the detachment of the upper portion 12 of the sleeve 10 from the lower portion 14 of the sleeve 10. In the present version, the detaching element 24 extends circumferentially across the sleeve 10 from the first side 20 to the second side 22, when the sleeve 10 is in a flattened state. Although the upper portion 12 and the lower portion 14 are shown as detachable via the detaching element 24, any detaching element, or combination of elements, or features, such as, but not by way of limitation, perforations, tear strips, zippers, and any other devices or elements of similar nature known in the art, or any combination thereof, which enable the tearing away or detachment of one object from another may be used. Therefore, while perforations are shown and described in detail herein as the detaching element 24, it will be understood that tear strips, zippers, or any other "detaching elements" known in the art, or any combination thereof, could be substituted therefore and/or used therewith as long as they functioned in accordance with the present invention.

The upper portion 12 of the sleeve 10 may also have an additional vertical detaching element (not shown) comprising a plurality of vertical perforations for facilitating removal of the upper portion 12.

It will be understood by a person of ordinary skill in the art that equipment and devices for forming floral sleeves are commercially available, and are well known to a person of ordinary skill in the art, e.g., see U.S. Pat. No. 5,496,251, the specification of which is hereby incorporated herein by reference. For example, the sleeves described herein may be formed by intermittently advancing two separate webs, one or two webs preformed in the form of a tube, or a single web folded double and sealing the longitudinal sides and bottom of the two facing panels then cutting the sleeve thus formed from the webs or web. Machines which can form sleeves from such single webs or pairs of webs are well within the knowledge of one of ordinary skill in the art.

It should also be noted that for all versions of sleeves described herein, it may be desirable to have a release material or cover strip covering the adhesive or cohesive bonding material, when a bonding material is disposed on any portion of the sleeve, for preventing the bonding material from bonding to another surface until the desired time. Further in each of the cases described herein wherein the sleeve 10 is applied to the pot 40 or a covered pot, the sleeve 10 may be applied thereto either by depositing the pot 40 or covered pot downwardly into the inner retaining space 15 of the sleeve 10, or the sleeve 10 may be brought upwardly about the pot 40 or covered pot from below the pot 40 or a covered pot.

It should be further noted that various features of the versions of the present invention, such as closure bonding areas, support extensions, handles, additional perforations, drainage holes, ventilation holes, and combinations of material, may be used alone or in combination as elements of any of the embodiments described above herein. Therefore, further discussion of the specific methods of construction of the sleeves described herein is not deemed necessary.

As noted above, the sleeve 10 includes a detaching element 24, when the sleeve 10 is in a flattened state, which extends generally horizontally from the first side 20 to the second side 22 and which enables the upper portion 12 to be separated from the lower portion 14. The lower portion 14 includes a decorative pattern (or decorative design) 26 which may be printed on the sleeve 10, attached to the sleeve 10, or inherent in the sleeve 10 in any manner which forms a non-linear upper boundary 28 on the sleeve 10. The portion of the sleeve 10 between the detaching element 24 and the non-linear upper boundary 28 of the decorative pattern 26 is clear and thus constitutes a clear zone 30 of the lower portion 14 of the sleeve 10. The non-linear upper boundary 28, in a preferred embodiment, comprises a series of peaks 32 which alternate with troughs 34. The peaks 32 are preferably of equal height, but may be of varying heights as discussed elsewhere herein. The portion of the sleeve 10 which is designed to extend above an upper rim 42 of the pot 40 is designated as a skirt portion 35 of the lower portion 14 of the sleeve 10. The decorative pattern 26 may be a solid color, or multicolored print, or may be comprised of a plurality of individual patterns, such as a floral print composed of a pattern of leaves and blossoms, or may be a separate material attached to the lower portion 14. The non-linear upper boundary 28 may be a distinct demarcation between the clear zone 30 and the decorative pattern 26, or may be a less definite boundary (for example, comprising edges of a floral print, but which when viewed from a distance still provides the sleeve 10 with an appearance of having a non-linear upper boundary 28). The decorative pattern 26 may cover all, or just a portion, of the lower portion 14 below the clear zone 30. The peaks 32 are preferably within about 0.0 mm to about 25 mm of the detaching element 24 and the troughs 34 are generally about 10 mm to about 60 mm below the detaching element 24. These distances are not absolute and the peaks 32 and troughs 34 of the non-linear upper boundary 28 may be lesser or greater than the distances listed above.

As shown in herein the non-linear upper boundary 28 of the decorative pattern 26 preferably comprises a curved pattern, for example, similar to a sine wave. However, the non-linear configuration of the non-linear upper boundary 28 of the decorative pattern 26 is not meant to be limited to such a curved design and may be constructed in any number of other non-linear patterns, for example as shown in FIGS. 12A–12D of U.S. Pat. No. 6,023,885, the specification and drawings of which are hereby incorporated herein by reference. Notable non-linear patterns which may be used include boundaries which have crenate, inverted crenate, crenelate or crenulate shapes. One of ordinary skill in the art will understand these are but a few of the patterns that the perforations may form and one of ordinary skill could contemplate many other suitable non-linear patterns.

The sleeve 10 may have apertures 36 in a portion thereof for enabling the sleeve 10 to be supported from a support device such as a wicket (not shown).

The sleeve 10 can be used to cover a potted plant. In FIG. 2 the sleeve 10 is shown in an opened condition disposed about the pot 40 having the floral grouping 50 disposed therein. The floral grouping 50 extends vertically a distance above the upper rim 42 of the pot 40. The floral grouping 50 has an upper portion 52 and a stem portion 54 which extends from the pot 40. As shown in the opened condition in FIG. 2, the sleeve 10 has an outer peripheral surface 44 and an inner peripheral surface 46. In a preferred embodiment, as shown in FIG. 2, the upper portion 12 is sized to substantially surround and encompass the floral grouping 50.

When the upper portion 12 of the sleeve 10 is removed from the lower portion 14 by detaching along the detaching element 24, the lower portion 14 of the sleeve 10 is left with an upper edge 48 which is more or less straight and which is disposed a distance above the upper rim 42 of the pot 40 (FIG. 3). Although the upper edge 48 of the lower portion 14 is substantially straight, the lower portion 14 is given the illusion of having a non-linear upper edge due to the conspicuousness of the non-linear upper boundary 28 of the decorative pattern 26 and the relative transparency and thus the invisibility, for all intents and purposes, of the clear zone 30. One advantage of having a generally straight detaching element 24 disposed a distance above the upper boundary 28 is that if the tear line is not torn exactly along the detaching element 24, the decorative nature of the upper boundary 28 of the decorative pattern 26 is not marred.

Figure 4:
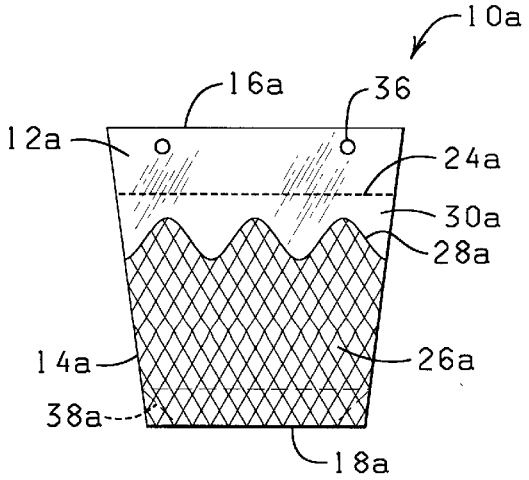
FIG. 4 is an elevational view of another sleeve constructed in accordance with the present invention.

Shown in FIG. 4 is an alternative embodiment of the present invention. Sleeve 10*a* is substantially similar to sleeve 10, except for the size of an upper portion 12*a*. The upper portion 12*a* is detachable from a lower portion 14*a* which has a decorative pattern 26*a* which has a non-linear upper boundary 28*a*. A detaching element 24*a* (a line of perforations) is disposed between the upper portion 12*a* and the lower portion 14*a*. As with the sleeve 10, the area of the lower portion 14*a* disposed between the detaching element 24*a* and the upper boundary 28*a* of the decorative pattern 26*a* constitutes a clear zone 30*a*. The sleeve 10*a* has an upper end 16*a* and a lower end 18*a* and may optionally comprise a gusset 38 therein. Contrary to the upper portion 12 of sleeve 10, the upper portion 12*a* of sleeve 10*a* is not sized to substantially surround and enclose a floral grouping (not shown). Rather, the upper portion 12*a* serves to support the sleeve 10*a*, via apertures 36, from a support device, such as a wicket (not shown), wherein a plurality of sleeves 10*a* can be supported together in the same manner as a plurality of sleeves 10 can be supported. When the upper portion 12*a* is separated from the lower portion 14*a* via the detaching element 24*a*, and the lower portion 14*a* is disposed about the pot 40, the lower portion 14*a* appears substantially the same as the lower portion 14 of the sleeve 10 shown in FIG. 3 after the upper portion 12 has been removed.

Shown in FIG. 5 is an alternative embodiment of the present invention. Sleeve 10*b* is substantially similar to sleeve 10 except the sleeve 10*b* does not include an upper portion detachable from a lower portion 14*b*. Sleeve 10*b* includes a decorative pattern 26*b* having a non-linear upper boundary 28*b*. The sleeve 10*b* has a clear zone 30*b* between the upper boundary 28*b* of the decorative pattern 26*b* and an upper edge 48*b* of the sleeve 10*b*. When opened and placed about a pot (not shown), sleeve 10*b* appears substantially the same as the embodiment of sleeve 10 shown in FIG. 3 after the upper portion 12 has been removed.

Figure 6:
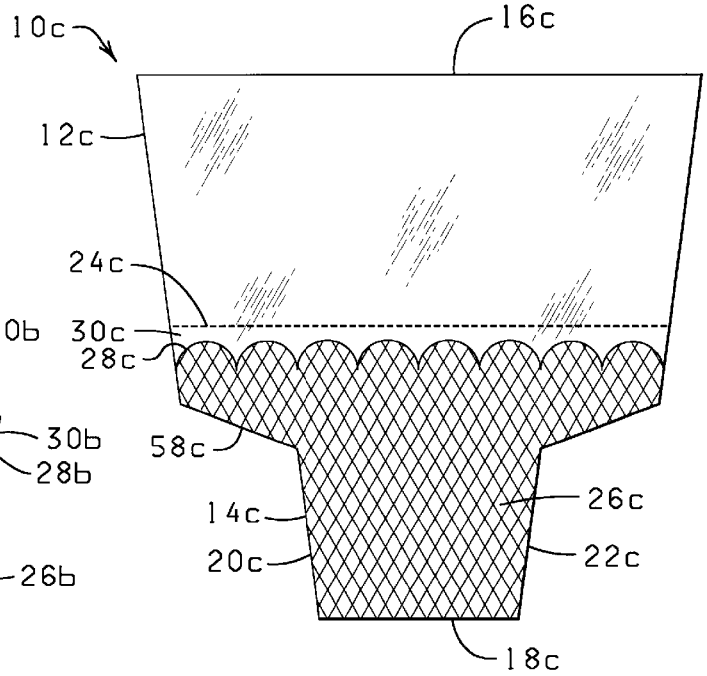
FIG. 6 is an elevational view of another sleeve constructed in accordance with the present invention.

Shown in FIG. 6 is a sleeve 10*c* which is substantially similar to the sleeve 10, comprising an upper portion 12*c*, a lower portion 14*c*, an upper end 16*c*, a lower end 18*c*, a substantially horizontal detaching element 24*c* (line of perforations) between the upper portion 12*c* and the lower portion 14*c*, a decorative pattern 26*c* having a non-linear upper boundary 28*c* and a clear zone 30*c* between the line of perforations 24*c* and the upper boundary 28*c* of the decorative pattern 26*c*. Sleeve 10*c* differs from sleeve 10 by having an outwardly-extending skirt portion 58*c* which extends angularly away from tapered first and second sides 20*c* and 22*c* of the lower portion 14*c* such that when the upper portion 12*c* is detached from the lower portion 14*c* and a pot is disposed in the lower portion 14*c*, the skirt portion 58*c* extends at an angle away from the lower portion 14*c*.

Figure 7:
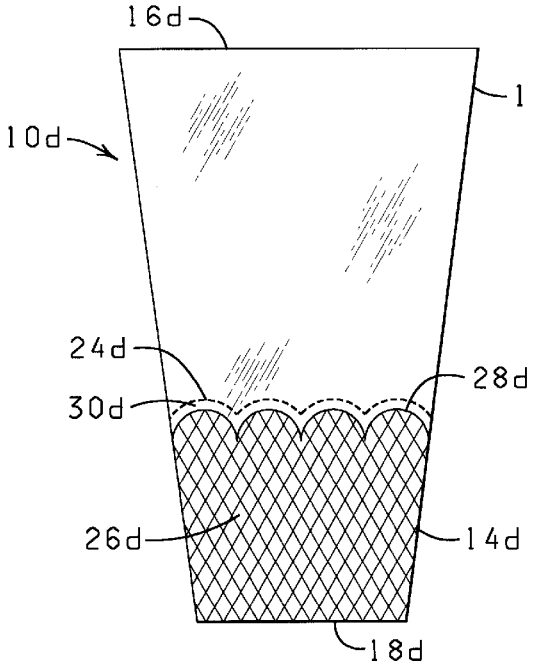
FIG. 7 is an elevational view of another sleeve constructed in accordance with the present invention.

Shown in FIG. 7 is a sleeve 10*d* which is substantially similar to the sleeve 10 shown in FIG. 1. The sleeve 10*d* has a decorative pattern 26*d* having a non-linear upper boundary 28*d*, and has a detaching element 24*d* disposed between an upper portion 12*d* and a lower portion 14*d*, and has a clear zone 30*d* between the upper boundary 28*d* of the decorative pattern 26*d* and the detaching element 24*d*. Sleeve 10*d* differs from sleeve 10 primarily in that the detaching element 24*d* has a pattern which generally corresponds to the curvature of the upper boundary 28*d* of the decorative pattern 26*d*. The clear zone 30*d* may be negligible or nonexistent.

FIGS. 8–14

Figure 8:
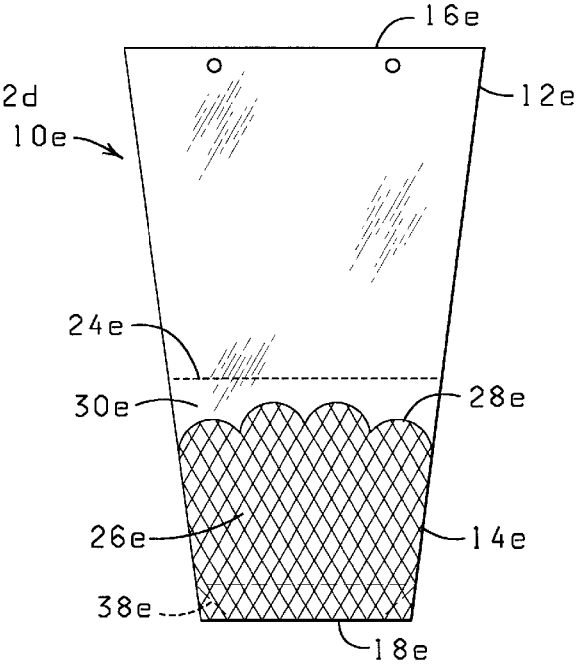
FIG. 8 is an elevational view of another sleeve constructed in accordance with the present invention.
Figure 9:
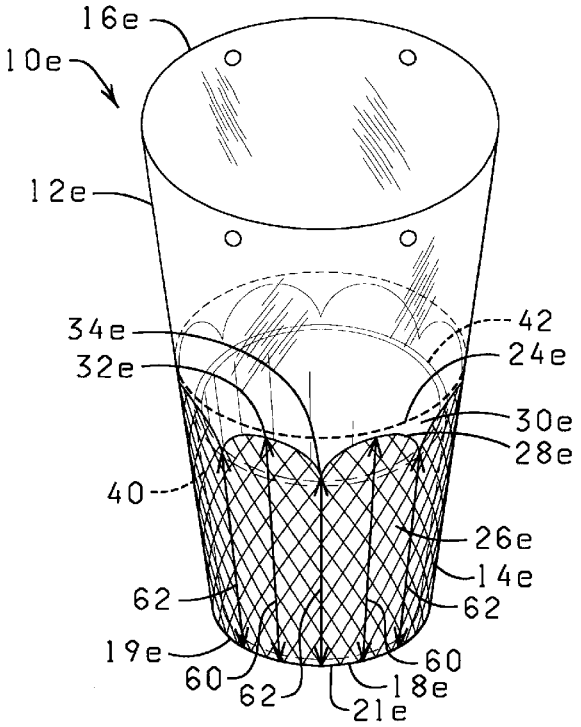
FIG. 9 is a perspective view of the sleeve of FIG. 8 when opened and with a pot disposed therein.
Figure 10:
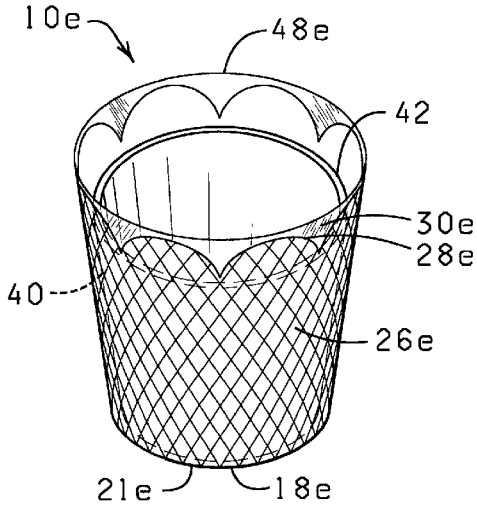
FIG. 10 is a perspective view of the opened sleeve of FIG. 8 after the upper portion has been detached therefrom.

Shown in FIGS. 8–10 is a sleeve 10*e* which is substantially the same as sleeve 10 except for a difference in the position of a non-linear upper boundary of a decorative pattern thereon. As with sleeve 10, sleeve 10*e* has an upper portion 12*e*, a lower portion 14*e*, and a detaching element 24*e* therebetween. The sleeve 10*e* further includes an upper end 16*e*, a lower end 18*e*, a decorative pattern 26*e* on the lower portion 14*e*, a non-linear upper boundary 28*e* in the decorative pattern 26*e* and a clear zone 30*e* between the detaching element 24*e* and the non-linear upper boundary 28*e*. The sleeve 10*e* may optionally further have a gusset 38*e* therein. The non-linear upper boundary 28*e* of the decorative pattern 26*e* is configured on the lower portion 14*e* such that when the sleeve 10*e* is in the open position (for example when disposed about the pot 40) FIG. 9, each peak 32*e* of the non-linear upper boundary 28*e* is disposed a substantially equal peak vertical distance 60 from a perimeter 21*e* of a bottom 19*e* of the opened sleeve 10*e*, and each trough 34*e* of the non-linear upper boundary 28*e* is disposed a substantially equal trough vertical distance 62 from the perimeter 21*e* of the bottom 19*e* of the opened sleeve 10*e*, as shown in FIGS. 9 and 10. Where used herein, the term "substantially equal" vertical distance means that when viewed from a typical viewer perspective, the peaks 32*e* appear to be about the same height to a viewer and the troughs 34*e* appear to be about the same height to a viewer.

When the upper portion 12*e* of sleeve 10*e* is removed from the lower portion 14*e* by detaching along the detaching element 24*e*, the lower portion 14*e* is left with a more or less straight upper edge 48*e* which is disposed a distance above the upper rim 42 of the pot 40 (FIG. 10) Although the upper edge 48*e* of the lower portion 14*e* is generally straight, the lower portion 14*e* is given the illusion of having a non-linear upper edge due to the conspicuousness of the non-linear upper boundary 28*e* of the decorative pattern 26*e* and the relative transparency, thus invisibility, of the clear zone 30*e* in a manner similar to that shown for sleeve 10 in FIG. 3.

Figure 11:
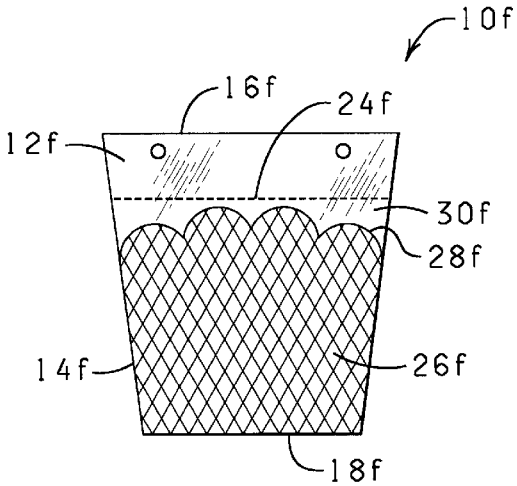
FIG. 11 is an elevational view of another sleeve constructed in accordance with the present invention.

Shown in FIG. 11 is an alternative embodiment of the present invention. Sleeve 10*f* is basically the same as sleeve 10*e*, except for the size of an upper portion 12*f*. The upper portion 12*f* is detachable from a lower portion 14*f* which includes thereon a decorative pattern 26*f* having a non-linear upper boundary 28*f*. A detaching element 24*f* is disposed between the upper portion 12*f* and the lower portion 14*f*. As with sleeve 10*e*, a clear zone 30*f* of the lower portion 14*f* is disposed between the detaching element 24*f* and the upper boundary 28*f* of the decorative pattern 26*f*. The sleeve 10*f* has an upper end 16*f* and a lower end 18*f* and may optionally include a gusset therein, as discussed in detail above. As opposed to the upper portion 12*e* of sleeve 10*e*, the upper portion 12*f* of sleeve 10*f* is not sized to substantially surround and enclose a floral grouping 50. Rather, the primary function of the upper portion 12*f* is to support the sleeve 10*f* from a support device such as a wicket (not shown) wherein a plurality of sleeves 10*f* can be supported together in the same manner as a plurality of sleeves 10*e* can be supported. When the upper portion 12*f* is separated from the lower portion 14*f* via detaching element 24*f*, and the lower portion 14*f* is disposed about a pot, the decorative cover formed from the lower portion 14*f* appears substantially the same as the embodiment of the sleeve 10*e* shown in FIG. 10.

Figure 12:
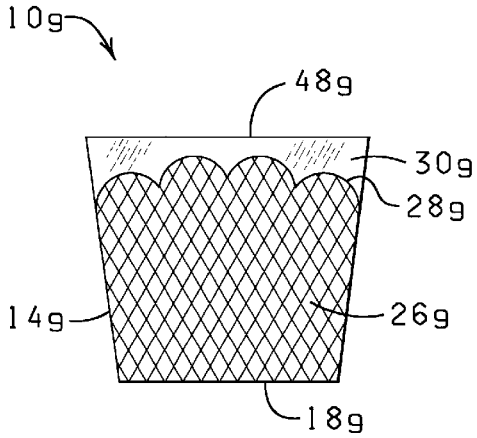
FIG. 12 is an elevational view of another sleeve constructed in accordance with the present invention.

Shown in FIG. 12 is an alternative embodiment of the present invention. Sleeve 10*g* is basically the same as sleeve 10*e* except sleeve 10*g* does not include an upper portion detachable from a lower portion 14*g*. Sleeve 10*g* includes a decorative pattern 26*g* having a non-linear upper boundary 28*g*. The sleeve 10*g* has a clear zone 30*g* between the upper boundary 28*g* of the decorative pattern 26*g* and an upper edge 48*g* of the sleeve 10*g*. When opened and placed about a pot, sleeve 10*g* appears substantially the same as the embodiment of sleeve 10*e* shown in FIG. 10 after the upper portion 12*e* has been detached.

Figure 13:
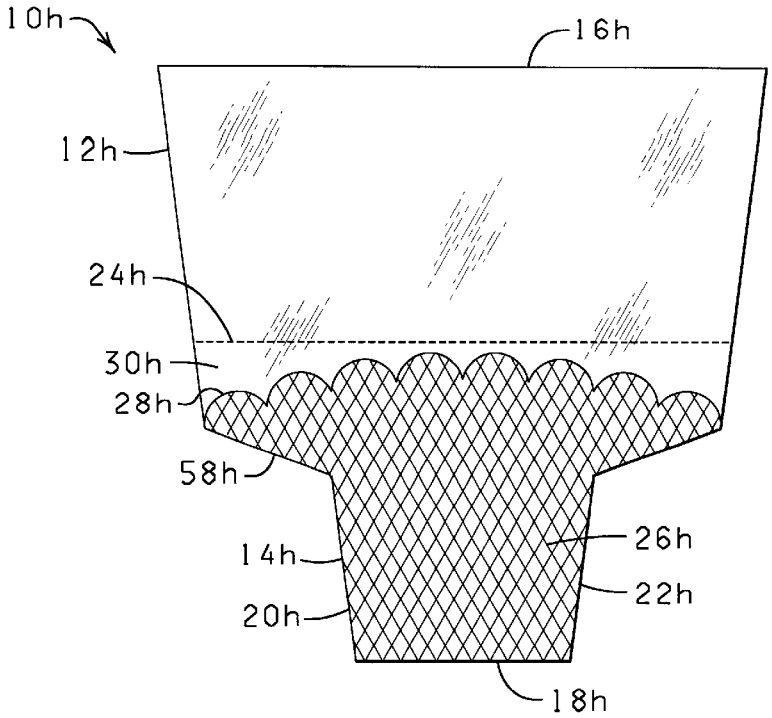
FIG. 13 is an elevational view of another sleeve constructed in accordance with the present invention.

Shown in FIG. 13 is a sleeve 10*h* which is substantially the same as sleeve 10*e*, comprising an upper portion 12*h*, a lower portion 14*h*, an upper end 16*h*, a lower end 18*h*, a more or less straight detaching element 24*h* between the upper portion 12*h* and the lower portion 14*h*, a decorative pattern 26*h* having a non-linear upper boundary 28*h* and a clear zone 30*h* between the detaching element 24*h* and the upper boundary 28*h* of the decorative pattern 26*h*. Sleeve 10*h* differs from sleeve 10*e* by having an outwardly-extending skirt portion 58*h* which extends away from tapered first and second sides 20*h* and 22*h* of the lower portion 14*h*, when the sleeve 10*h* is in a flattened state, such that when the upper portion 12*h* is detached from the lower portion 14*h* and a pot not shown is disposed in the lower portion 14*h*, the sleeve 10*h* has the skirt portion 58*h* which extends at an angle away from the lower portion 14*h*.

Figure 14:
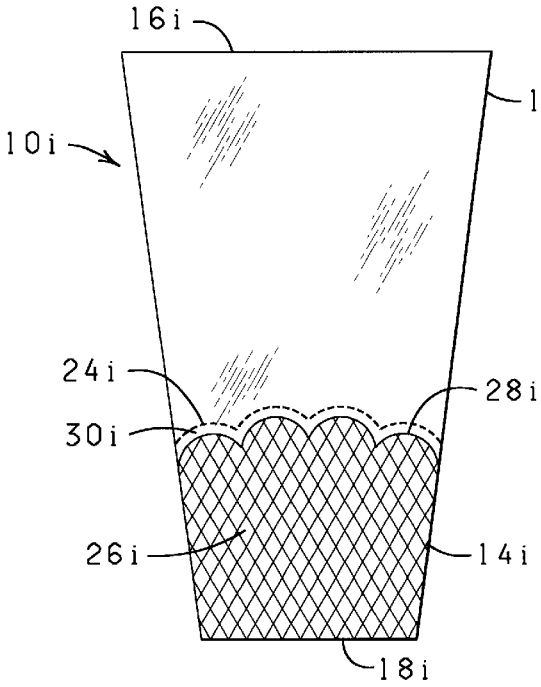
FIG. 14 is an elevational view of another sleeve constructed in accordance with the present invention.

Shown in FIG. 14 is a sleeve 10i which is substantially the same as sleeve 10*e* shown in FIG. 8. The sleeve 10*i* has a decorative pattern 26*i* having a non-linear upper boundary 28*i*, and has a detaching element 24*i* disposed between an upper portion 12*i* and a lower portion 14*i*, and has a clear zone 30*i* between the non-linear upper boundary 28*i* of the decorative pattern 26*i* and the detaching element 24*i*. Sleeve 10*i* differs from sleeve 10*e* primarily in that the detaching element 24*i* has a pattern which generally corresponds to the curvature of the non-linear upper boundary 28*i*. The clear portion 30*i*, therefore, may be negligible or non-existent.

FIGS. 15–21

Figure 15:
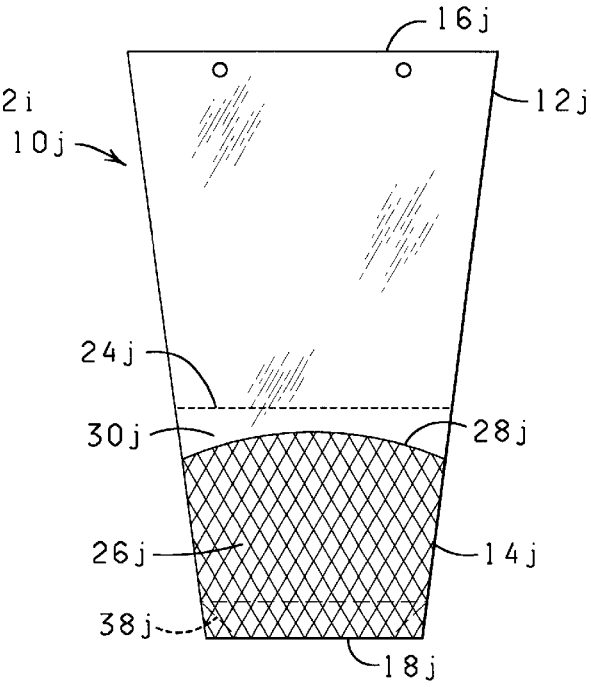
FIG. 15 is an elevational view of another sleeve constructed in accordance with the present invention.
Figure 16:
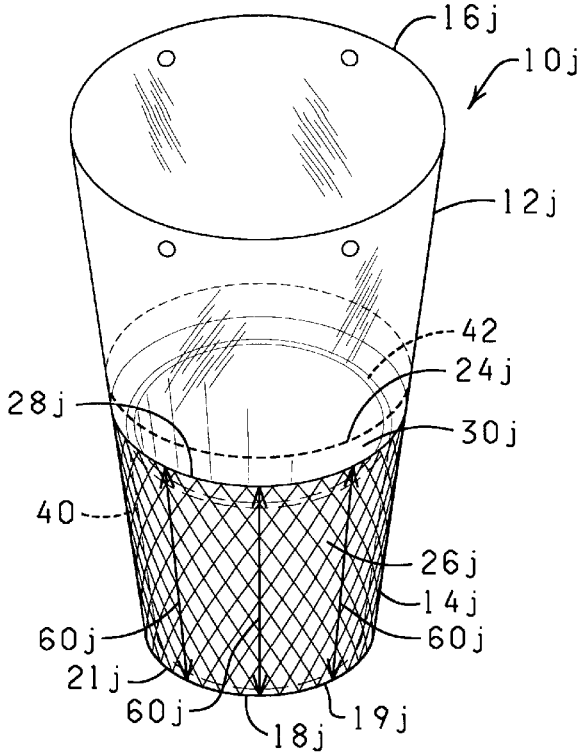
FIG. 16 is a perspective view of a pot disposed within the opened sleeve of FIG. 15.
Figure 17:
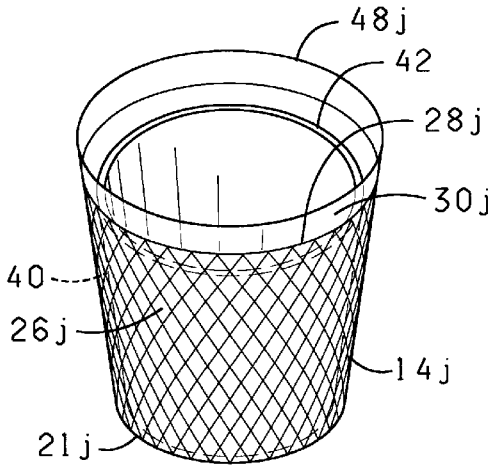
FIG. 17 is a perspective view of the sleeve and pot of FIG. 16 after an upper portion of the sleeve has been removed from the lower portion.

Shown in FIGS. 15–17 is a sleeve 10*j* which is basically the same as sleeve 10*e* except for a difference in an upper boundary of a decorative pattern thereon. As with sleeve 10*e*, sleeve 10*j* has an upper portion 12*j*, a lower portion 14*j*, and a detaching element 24*j* therebetween. The sleeve 10*j* further comprises an upper end 16*j*, a lower end 18*j*, a decorative pattern 26*j* on the lower portion 14*j*, an arcuate upper boundary 28*j* in the decorative pattern 26*j* and a clear zone 30*j* between the detaching element 24*j* and the arcuate upper boundary 28*j*. The sleeve 10*j* may optionally further have a gusset 38*j* therein. The arcuate upper boundary 28*j* of the decorative pattern 26*j* is configured on the lower portion 14*j* such that when the sleeve 10*j* is in an open position (for example when disposed about the pot 40), the arcuate upper boundary 28*j* of the decorative pattern 26*j* is disposed a substantially equivalent vertical distance 60*j* from a perimeter 21*j* of a bottom 19*j* of the opened sleeve 10*j*. That is, the plane of the arcuate upper boundary 28*j* is substantially parallel to a plane of the perimeter 21*j* of the bottom 19*j* as shown in FIG. 16, and parallel to the upper rim 42 of the pot 40 when the pot 40 is disposed therein, as in FIGS. 16 and 17.

When the upper portion 12*j* is removed from the lower portion 14*j* by detaching along the detaching element 24*j*, the lower portion 14*j* is left with an upper edge 48*j* which is disposed a distance above the upper rim 42 of the pot 40 (FIG. 17). The lower portion 14*j* is given the illusion of having an upper edge which corresponds to the upper rim 42 of the pot 40 due to the conspicuousness of the arcuate upper boundary 28*j* of the decorative pattern 26*j* and the relative transparency, and thus invisibility, of the clear zone 30*j*.

Figure 18:
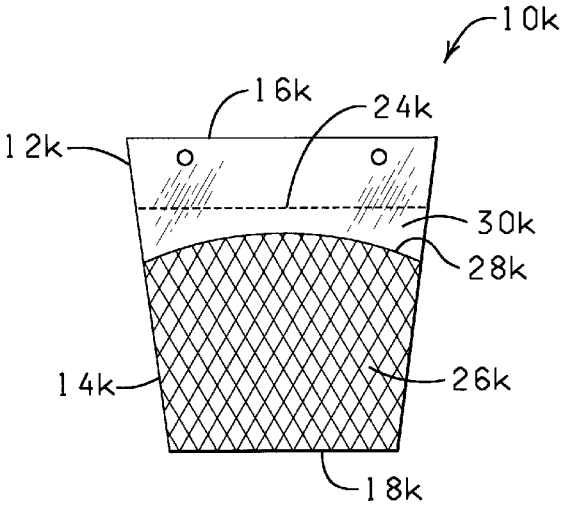
FIG. 18 is an elevational view of another sleeve constructed in accordance with the present invention.

Shown in FIG. 18 is an alternative embodiment of the present invention. Sleeve 10*k* is basically the same as sleeve 10*j*, except for the size of an upper portion 12*k*. The upper portion 12*k* is detachable from the lower portion 14*k* which includes thereon a decorative pattern 26*k* which has an arcuate upper boundary 28*k*. A detaching element 24*k* is disposed between the upper portion 12*k* and the lower portion 14*k*. As with sleeve 10*j*, the portion of the lower portion 14*k* disposed between the detaching element 24*k* and the upper boundary 28*k* of the decorative pattern 26*k* is a clear zone 30*k*. The sleeve 10*k* has an upper end 16*k* and a lower end 18*k* and may optionally include a gusset therein. As opposed to the upper portion 12*j* of sleeve 10*j*, the upper portion 12*k* of sleeve 10*k* is not sized to substantially surround and enclose a floral grouping 50. Rather, the primary function of the upper portion 12*k* is to support the sleeve 10*k* from a support device, such as a wicket (not shown), wherein a plurality of sleeves 10*k* can be supported together in the same manner as a plurality of sleeves 10*j* can be supported. When the upper portion 12*k* is separated from the lower portion 14*k* via the detaching element 24*k*, and the lower portion 14*k* is disposed about a pot not shown, the decorative cover formed from the lower portion 14*k* appears substantially the same as the embodiment of sleeve 10*j* shown in FIG. 17 after the upper portion 12*j* has been detached.

Figure 19:
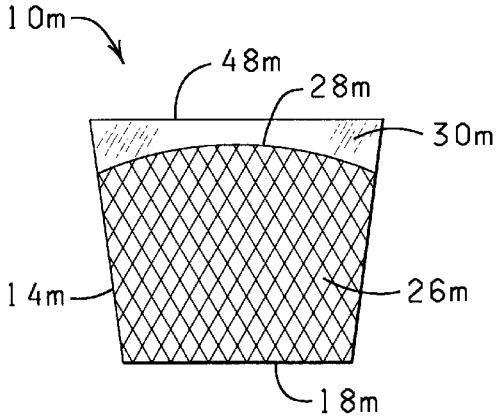
FIG. 19 is an elevational view of another sleeve constructed in accordance with the present invention.

Shown in FIG. 19 is an alternative embodiment of the present invention. Sleeve 10*m* is substantially the same as sleeve 10*j* except sleeve 10*m* does not include an upper portion detachable from the lower portion 14*m*. Sleeve 10*m* includes a decorative pattern 26*m* having an arcuate upper boundary 28*m*. The sleeve 10*m* has a clear zone 30*m* between the arcuate upper boundary 28*m* of the decorative pattern 26*m* and an upper edge 48*m* of the sleeve 10*m*. When opened and placed about a pot (not shown), sleeve 10*m* appears substantially the same as the embodiment of sleeve 10*j* shown in FIG. 17 after the upper portion 12*j* has been detached.

Figure 20:
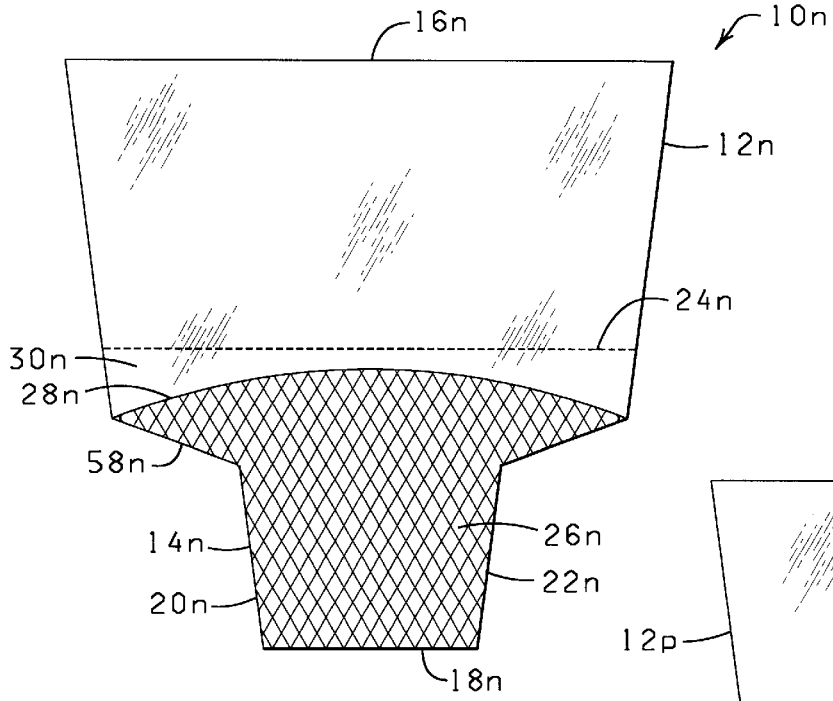
FIG. 20 is an elevational view of another sleeve constructed in accordance with the present invention.

Shown in FIG. 20 is a sleeve 10*n* which is substantially the same as sleeve 10*j*, comprising an upper portion 12*n*, a lower portion 14*n*, an upper end 16*n*, a lower end 18*n*, a substantially horizontal detaching element 24*n* between the upper portion 12*n* and the lower portion 14*n*, a decorative pattern 26*n* having an arcuate upper boundary 28*n* and a clear zone 30*n* between the detaching element 24*n* and the upper boundary 28*n* of the decorative pattern 26*n*. In particular, sleeve 10*n* differs from sleeve 10*j* by having an outwardly-extending skirt portion 58*n* which extends away from tapered first and second sides 20*n* and 22*n* of the lower portion 14*n*, when the sleeve 10*n* is in a flattened state, such that when the upper portion 12*n* is detached from the lower portion 14*n* and the pot 40 is disposed in the lower portion 14*n*, the sleeve 10*n* has the skirt portion 58*n* which extends at an angle away from the lower portion 14*n*.

Figure 21:
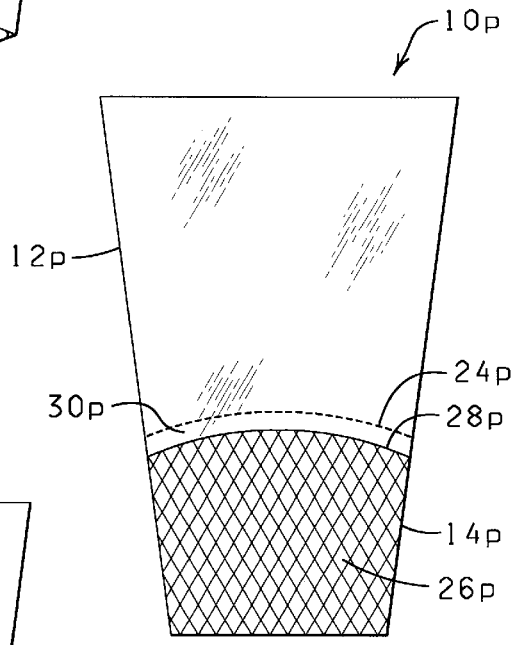
FIG. 21 is an elevational view of another sleeve constructed in accordance with the present invention.

Shown in FIG. 21 is a sleeve 10*p* which exactly the same as sleeve 10*j* shown in FIG. 15 wherein the sleeve 10*p* has a decorative pattern 26*p* having an arcuate upper boundary 28*p*, and has a detaching element 24*p* disposed between an upper portion 12*p* and a lower portion 14*p*, and has a clear zone 30*p* between the arcuate upper boundary 28*p* of the decorative pattern 26*p* and the detaching element 24*p*. Sleeve lop differs from sleeve 10*j* primarily in that the detaching element 24*p* has a pattern which generally corresponds to the curvature of the arcuate upper boundary 28*p* of the decorative pattern 26*p*. The clear zone 30*p* may alternatively be negligible or non-existent.

FIGS. 22–25

Figure 22:
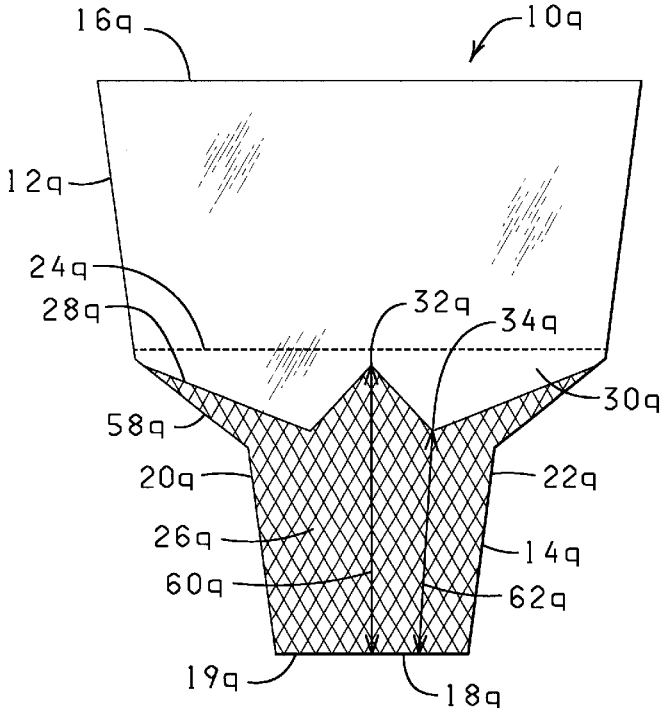
FIG. 22 is an elevational view of another sleeve constructed in accordance with the present invention.

Shown in FIG. 22 is a sleeve 10*q* which is basically the same as sleeve 10*c* shown in FIG. 6 except for a difference in the position of the non-linear upper boundary of a decorative pattern thereon. As with sleeve 10*c*, sleeve 10*q* has an upper portion 12*q*, a lower portion 14*q*, and a detaching element 24*q* therebetween. The sleeve 10*q* further comprises an upper end 16*q*, a lower end 18*q*, a decorative pattern 26*q* on the lower portion 14*q*, an angularly shaped non-linear upper boundary 28*q* in the decorative pattern 26*q* and a clear zone 30*q* between the detaching element 24*q* and the non-linear upper boundary 28*q*. The sleeve 10*q* also has an inner peripheral surface (not shown) which, when the sleeve 10 is opened, defines and encompasses an inner retaining space as indicated in FIGS. 2 and 3. The sleeve 10*q* may optionally further have a gusset therein. The non-linear upper boundary 28*q* of the decorative pattern 26*q* is configured on the lower portion 14*q* such that when the sleeve 10*q* is in the open position (for example when disposed about a pot), each peak 32*q* of the non-linear upper boundary 28*q* is disposed a substantially equal peak vertical distance 60*q* from a perimeter 21*q* of a bottom 19*q* of the opened sleeve 10*q* and each trough 34*q* of the non-linear upper boundary 28*q* is disposed a substantially equal trough vertical distance 62*q* from the perimeter 21*q* of the bottom 19*q* of the opened sleeve 10*q* in a manner similar to that shown for sleeve 10*e* in FIG. 9.

When the upper portion 12*q* is removed from the lower portion 14*q* by detaching along the detaching element 24*q*, the lower portion 14*q* is left with a more or less straight upper end which is disposed a distance above an upper rim of a pot. Although the remaining upper end is generally straight, the lower portion 14*q* is given the illusion of having an angular upper edge due to the conspicuousness of the non-linear upper boundary 28*q* of the decorative pattern 26*q* and the relative transparency and thus invisibility of the clear zone 30*q*.

Sleeve 10*q* further comprises an outwardly-extending skirt portion 58*q* which extends away from [the] tapered first and second sides 20*q* and 22*q* of the lower portion 14*q* such that when the upper portion 12*q* is detached from the lower portion 14*q* and the pot 40 is disposed in the lower portion 14*q*, the sleeve 10*q* has a skirt portion 58*q* which extends at an angle away from the lower portion 14*q*.

Figure 23:
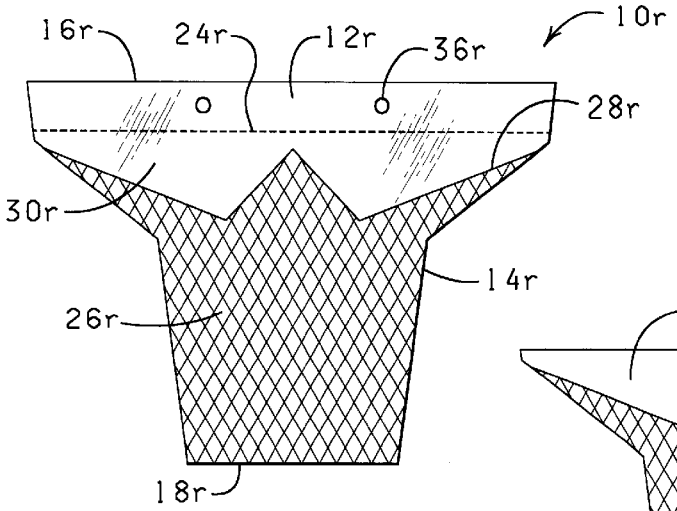
FIG. 23 is an elevational view of another sleeve constructed in accordance with the present invention.

Shown in FIG. 23 is an alternative embodiment of the present invention. Sleeve 10*r* is basically the same as sleeve 10*q*, except for the size of an upper portion 12*r*. The upper portion 12*r* is detachable from a lower portion 14*r* which has a decorative pattern 26*r* which has an angularly shaped non-linear upper boundary 28*r*. A detaching element 24*r* is disposed between the upper portion 12*r* and the lower portion 14*r*. As with sleeve 10*q*, a clear zone 30*r* of the lower portion 14*r* is disposed between the non-linear upper boundary 28*r* of the decorative pattern 26*r* and an upper end 16*r*. The sleeve 10*r* also has a lower end 18*r* and may optionally include a gusset therein. Contrary to the upper portion 12*q* of sleeve 10*q*, the upper portion 12*r* of sleeve 10*r* is not sized to substantially surround and encompass a floral grouping. Rather, the primary function of the upper portion 12*r* is to support the sleeve 10*r* from a support device, such as a wicket (not shown), via apertures 36*r*, whereby a plurality of sleeves 10*r* can be supported together. When the upper portion 12*r* is separated from the lower portion 14*r* via the detaching element 24*r*, and the lower portion 14*r* is disposed about a pot, the decorative cover formed from the lower portion 14*r* appears substantially the same as the embodiment of sleeve 10*q* after the upper portion 12*q* is removed.

Figure 24:
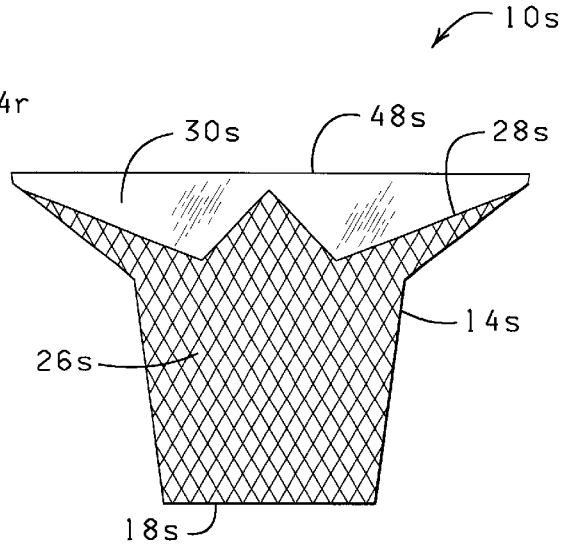
FIG. 24 is an elevational view of another sleeve constructed in accordance with the present invention.

Shown in FIG. 24 is an alternative embodiment of the present invention. Sleeve 10*s* is basically the same as sleeve 10*q* except sleeve 10*s* does not include an upper portion detachable from a lower portion 14*s*. Sleeve 10*s* includes a decorative pattern 26*s* having an angularly shaped non-linear upper boundary 28*s*. The sleeve 10*s* has a clear zone 30*s* between the non-linear upper boundary 28*s* of the decorative pattern 26*s* and an upper edge 48*s* of the sleeve 10*s*. When opened and placed about a pot (not shown), sleeve 10*s* appears substantially the same as the embodiment of sleeve 10*q* after the upper portion 12*q* is removed therefrom.

Figure 25:
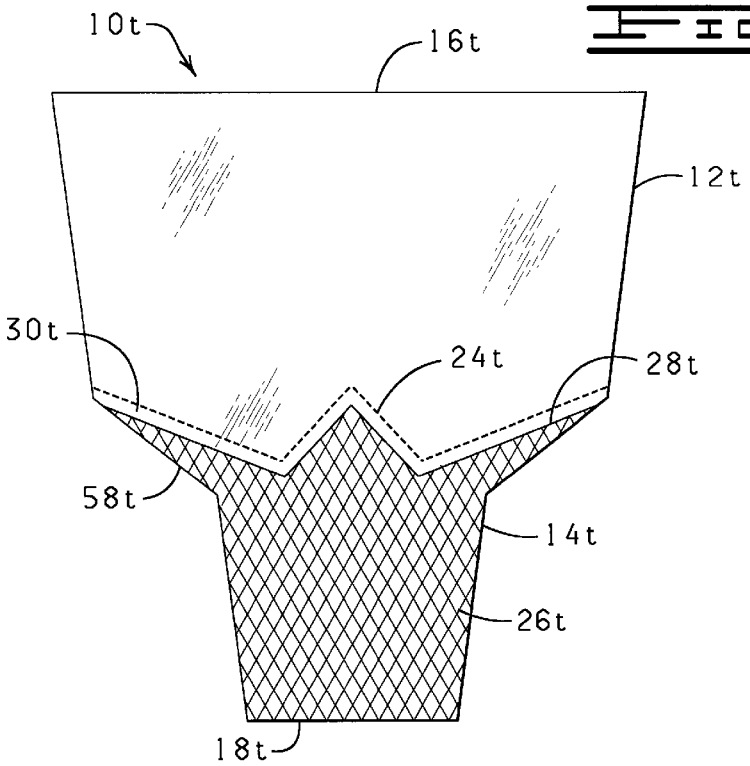
FIG. 25 is an elevational view of another sleeve constructed in accordance with the present invention.

Shown in FIG. 25 is a sleeve 10*t* which is basically the same as sleeve 10*q* shown in FIG. 22 wherein the sleeve 10*t* has a decorative pattern 26*t* having an angularly shaped non-linear upper boundary 28*t*, and has a detaching element 24*t* disposed between an upper portion 12*t* and a lower portion 14*t*, and has a clear zone 30*t* between the non-linear upper boundary 28*t* of the decorative pattern 26*t* and the detaching element 24*t*. Sleeve 10*t* differs from sleeve 10*q* primarily in that the detaching element 24*t* has a pattern which generally corresponds to the angular curvature of the non-linear upper boundary 28*t* of the decorative pattern 26*t*. The clear zone 30*t* may be negligible or non-existent.

FIGS. 26–29

Figure 26:
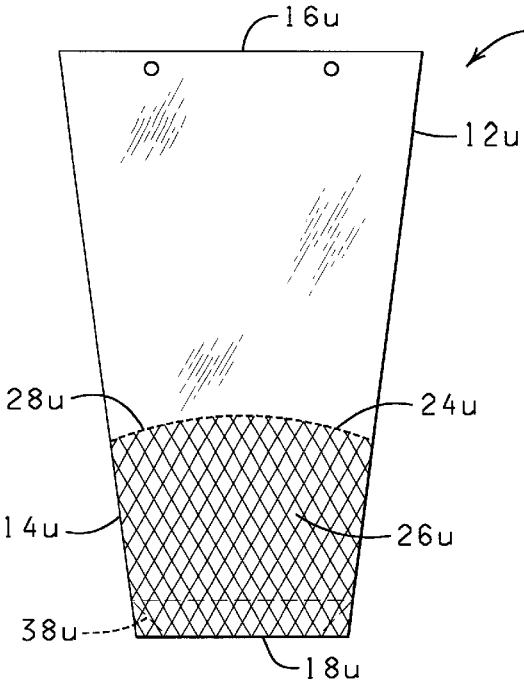
FIG. 26 is an elevational view of another sleeve constructed in accordance with the present invention.

Shown in FIG. 26 is a sleeve 10*u* which is substantially the same as sleeve 10*j* (FIG. 15) except for a difference in the relation of a non-linear upper boundary of a decorative pattern thereon and a detaching element therein. As with sleeve 10*j*, sleeve 10*u* has an upper portion 12*u*, a lower portion 14*u*, and a detaching element 24*u* therebetween. The sleeve 10*u* further includes an upper end 16*u*, a lower end 18*u*, a decorative pattern 26*u* on the lower portion 14*u*, and an arcuate upper boundary 28*u* in the decorative pattern 26*u* which has an arcuate shape, when the sleeve 10*u* is in a flattened state. The sleeve 10*u* may optionally further have a gusset 38*u* therein. The arcuate upper boundary 28*u* of the decorative pattern 26*u* is configured to coincide with the detaching element 24*u*. When the upper portion 12*u* is removed from the lower portion 14*u*, the arcuate upper boundary 28*u* of the decorative pattern 26*u* comprises an upper end of the remaining lower portion 14*u* of the sleeve 10*u*. Sleeve 10*u* is the same as sleeve 10*p* in FIG. 21 when there is no clear zone 30*r* in sleeve lop.

Figure 27:
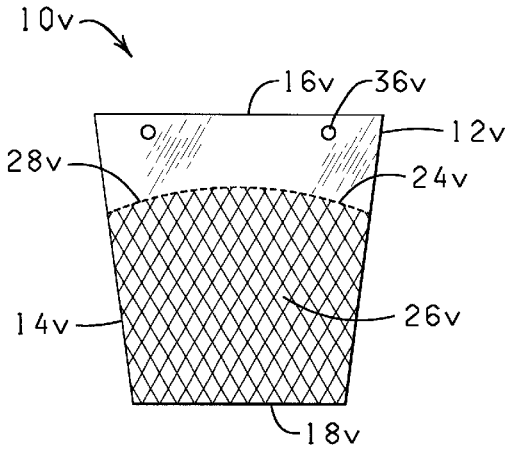
FIG. 27 is an elevational view of another sleeve constructed in accordance with the present invention.

Shown in FIG. 27 is an alternative embodiment of the present invention. Sleeve 10*v* is basically the same as sleeve 10*u*, except for the size of an upper portion 12*v*. The upper portion 12*v* is detachable from a lower portion 14*v* which includes thereon a decorative pattern 26*v* which has an arcuate upper boundary 28*v*, when the sleeve 10*v* is in a flattened state. A detaching element 24*v* is disposed between the upper portion 12*v* and the lower portion 14*v*. As with sleeve 10*u*, the arcuate upper boundary 28*v* of the decorative pattern 26*v* coincides with the detaching element 24*v*. The sleeve 10*v* has an upper end 16*v* and a lower end 18*v* and may optionally comprise a gusset therein. Contrary to the upper portion 12*u* of sleeve 10*u*, the upper portion 12*v* of sleeve 10*v* is not sized to substantially surround and enclose a floral grouping. Rather, the primary function of the upper portion 12*v* is to support the sleeve 10*v* from a support device, via apertures 36*v*, such as a wicket (not shown), wherein a plurality of sleeves 10*v* can be supported together in the same manner as a plurality of sleeves 10*u* can be supported. When the upper portion 12*v* is separated from the lower portion 14*v* via the detaching element 24*v*, the decorative cover formed from the lower portion 14*v* appears substantially the same as lower portion 14*u* of sleeve 10*u* when the upper portion 12*q* is detached therefrom.

Figure 28:
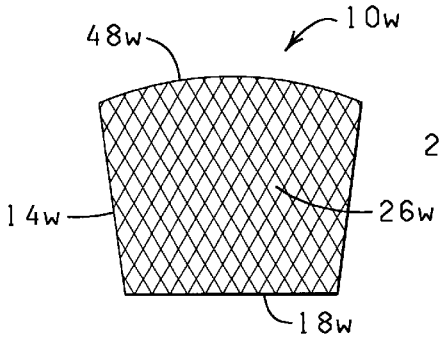
FIG. 28 is an elevational view of another sleeve constructed in accordance with the present invention.

Shown in FIG. 28 is an alternative embodiment of the present invention. Sleeve 10*w* is substantially the same as sleeve 10*u* except the sleeve 10*w* comprises only a body 14*w*, not an upper portion detachable from a lower portion. Sleeve 10*w* includes a decorative pattern 26*w* having an arcuate upper edge 48*w* having an arcuate shape when in a flattened condition. When opened and placed about a pot, sleeve 10*w* appears substantially the same as the embodiment of sleeve 10*u* after the upper portion 12*u* is removed and the remaining lower portion 14*u* is disposed about a pot.

Figure 29:
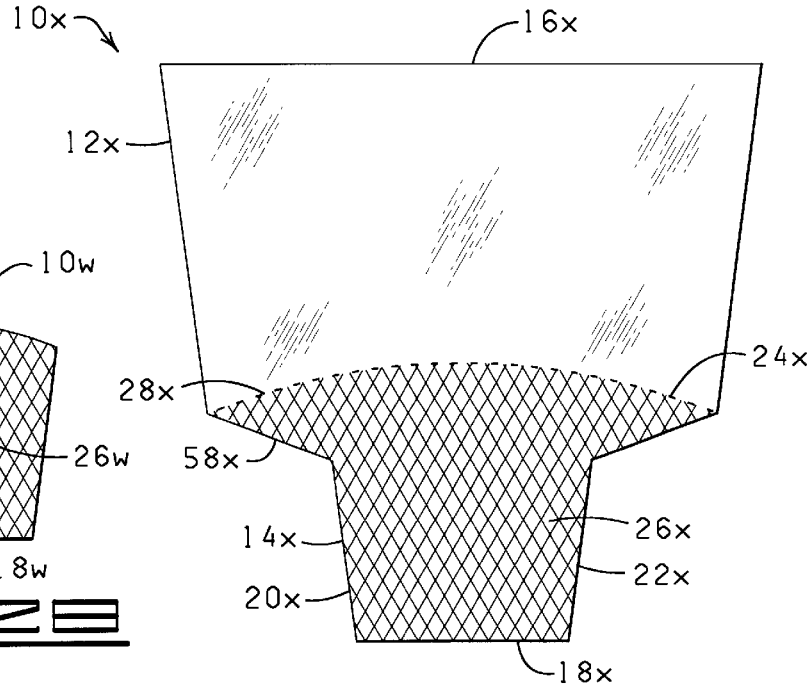
FIG. 29 is an elevational view of another sleeve constructed in accordance with the present invention.

Shown in FIG. 29 is a sleeve 10*x* which is substantially the same as sleeve 10*u*, comprising an upper portion 12*x*, a lower portion 14*x*, an upper end 16*x*, a lower end 18*x*, and an arcuate detaching element 24*x* which coincides with an arcuate upper boundary 28*x* of a decorative pattern 26*x*, the arcuate upper boundary 28*x* having an arcuate shape when the sleeve 10*x* is in a flattened state. Sleeve 10*x* differs from sleeve 10*u* by having an outwardly-extending skirt portion 58*x* which extends away from tapered first and second sides 20*x* and 22*x* of the lower portion 14*x*, when the sleeve 10*x* is in the flattened state, such that when the upper portion 12*x* is detached from the lower portion 14*x* and a pot is disposed in the lower portion 14*x*, the skirt portion 58*x* extends at an angle away from the lower portion 14*x*.

FIGS. 30–33

Figure 30:
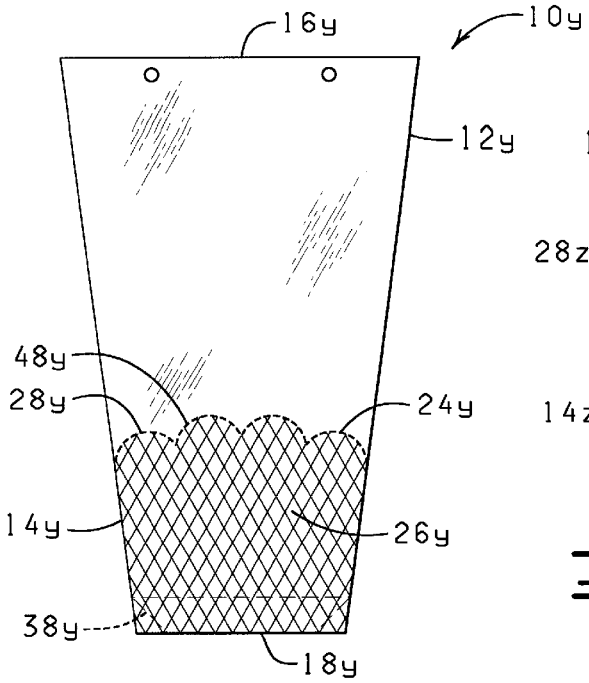
FIG. 30 is an elevational view of another sleeve constructed in accordance with the present invention.

Shown in FIG. 30 is a sleeve 10*y* which is substantially the same as sleeve 10*e* in FIG. 8 except for a difference in the position of a detaching element 24*y*. As with sleeve 10*e*, sleeve 10*y* has an upper portion 12*y*, a lower portion 14*y*, and the detaching element 24*y* therebetween. The sleeve 10*y* further includes an upper end 16*y*, a lower end 18*y*, a decorative pattern 26*y* on the lower portion 14*y*, and a non-linear upper boundary 28*y* in the decorative pattern 26*y*. The non-linear upper boundary 28*y* of the decorative pattern 26*y* is configured to coincide with the detaching element 24*y*. When the upper portion 12*y* is removed from the lower end 14*y*, the non-linear upper boundary 28*y* of the decorative pattern 26*y* comprises an upper edge 48*y* of the remaining lower portion 14*y* of the sleeve 10*y*. The sleeve 10*y* may optionally further have a gusset 38*y* therein. Sleeve 10*y* is the same as sleeve 10*w* (FIG. 28), as there is no clear zone in sleeve 10*y*.

Figure 31:
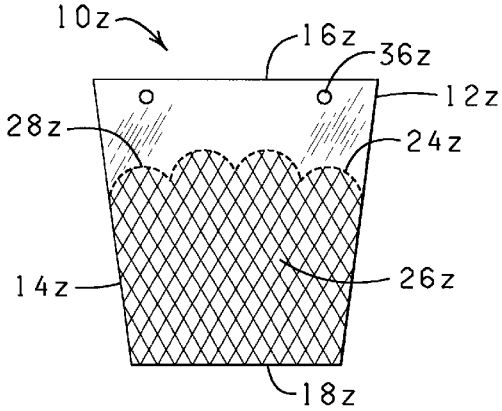
FIG. 31 is an elevational view of another sleeve constructed in accordance with the present invention.

Shown in FIG. 31 is an alternative embodiment of the present invention. Sleeve 10*z* is essentially the same as sleeve 10*y*, except for the size of an upper portion 12*z*. The upper portion 12*z* is detachable from a lower portion 14*z* which includes thereon a decorative pattern 26*z* which has a non-linear upper boundary 28*z*. A detaching element 24*z* is disposed between the upper portion 12*z* and the lower portion 14*z* and coincides with the non-linear upper boundary 28*z*. The sleeve 10*z* has an upper end 16*z* and a lower end 18*z* and may optionally comprise a gusset therein. As opposed to the upper portion 12*y* of sleeve 10*y*, the upper portion 12*z* of sleeve 10*z* is not sized to substantially surround and encompass a floral grouping. Rather, the primary function of the upper portion 12*z* is to support the sleeve 10*z* from a support device, such as a wicket (not shown), via apertures 36*z* wherein a plurality of sleeves 10*z* can be supported together in the same manner as a plurality of sleeves 10*y* can be supported. When the upper portion 12*z* is separated from the lower portion 14*z* via the detaching element 24*z*, and the lower portion 14*z* is disposed about a pot, the decorative cover formed from the lower portion 14*z* appears substantially the same as the embodiment of sleeve 10*y* after the upper portion 12*y* has been removed therefrom.

Figure 32:
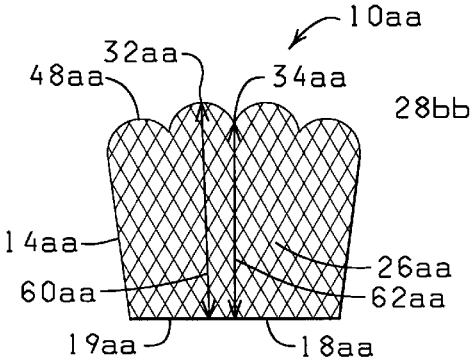
FIG. 32 is an elevational view of another sleeve constructed in accordance with the present invention.

Shown in FIG. 32 is an alternative embodiment of the present invention. Sleeve 10*aa* is basically the same as sleeve 10*y* except sleeve 10*aa* does not include an upper portion detachable from a lower portion 14*aa*. Sleeve 10*aa* includes a decorative pattern 26*aa* having a non-linear upper edge 48*aa*. The non-linear upper edge 48*aa* is comprised of peaks 32*aa* and troughs 34*aa*. When opened and placed about a pot, sleeve 10*aa* appears substantially the same as the embodiment of sleeve 10*y* or sleeve 10*z* after the upper portion 12*y* or 12*z* has been removed and the remaining lower portion 14*y* or 14*z* has been disposed about a pot. That is, the upper edge 48*aa* of the sleeve 10*aa* is configured such that when the sleeve 10*aa* is in the open position (for example when disposed about a pot), each peak 32*aa* of the upper edge 48*aa* is disposed about a substantially equal peak vertical distance 60*aa* from an edge 19*aa* of lower end 18*aa* of the opened sleeve 10*aa* and each trough 34*aa* of the upper edge 48*aa* is disposed about a substantially equal trough vertical distance 62*aa* from the edge 19*aa* of the lower end 18*aa* of the opened sleeve 10*aa*, in a manner similar to sleeve 10*e* shown in FIG. 10.

Figure 33:
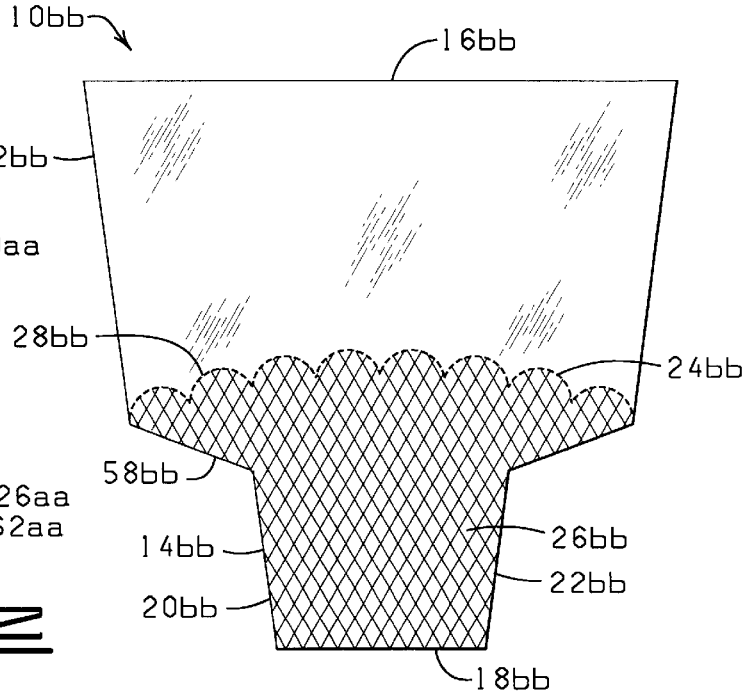
FIG. 33 is an elevational view of another sleeve constructed in accordance with the present invention.
Figure 34:
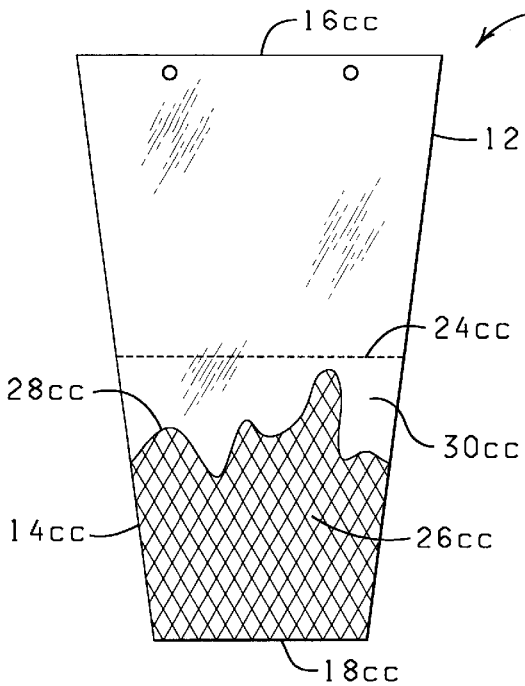
FIG. 34 is an elevational view of another sleeve constructed in accordance with the present invention.
Figure 35:
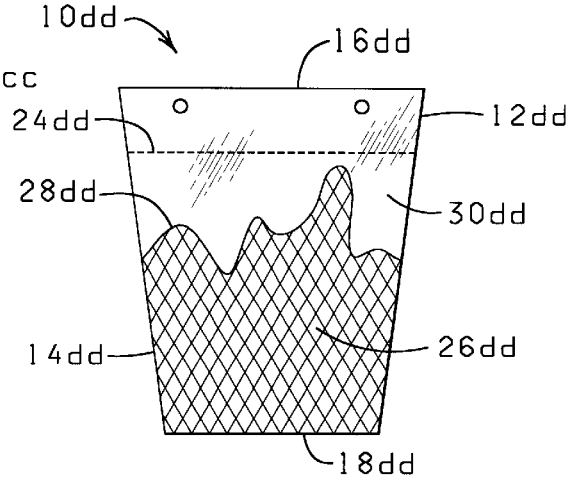
FIG. 35 is an elevational view of another sleeve constructed in accordance with the present invention.
Figure 36:
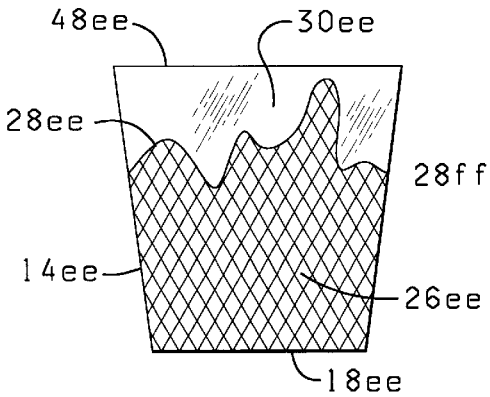
FIG. 36 is an elevational view of another sleeve constructed in accordance with the present invention.
Figure 37:
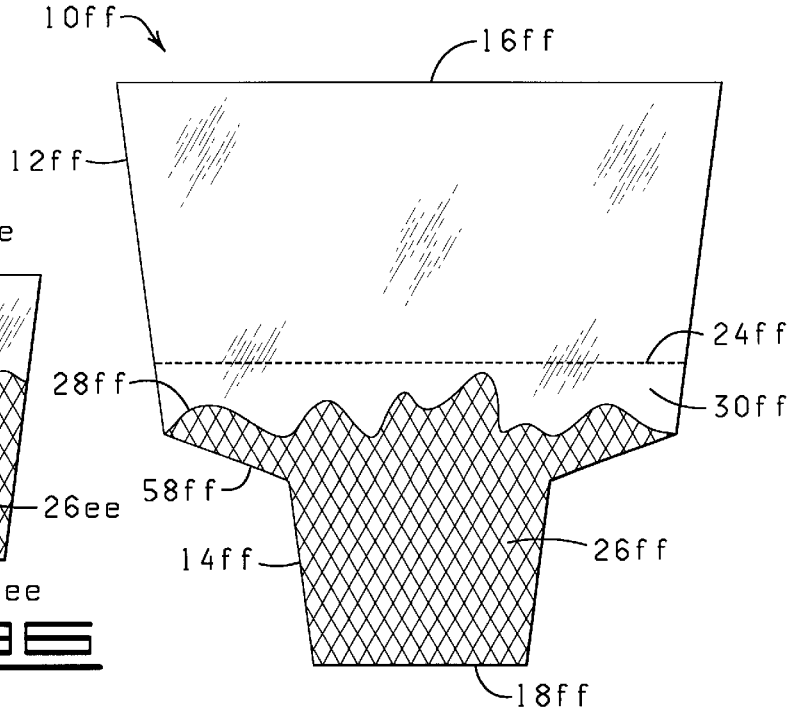
FIG. 37 is an elevational view of another sleeve constructed in accordance with the present invention.

Shown in FIG. 33 is a sleeve 10*bb* which is substantially the same as sleeve 10*y*, comprising an upper portion 12*bb*, a lower portion 14*bb*, an upper end 16*bb*, a lower end 18*bb* and a non-linear detaching element 24*bb* which correspond to a non-linear upper boundary 28*bb* of a decorative pattern 26*bb*. Sleeve 10*bb* differs from sleeve 10*y* by having an outwardly-extending skirt portion 58*bb* which extends away from tapered first and second sides 20*bb* and 22*bb* of the lower portion 14*bb*, when the sleeve 10*bb* is in a flattened state, such that when the upper portion 12*bb* is detached from the lower portion 14*bb* and a pot is disposed in the lower portion 14*bb*, the sleeve 10*bb* has the skirt portion 58*bb* which extends at an angle away from the lower end 14*bb*.

FIGS. 34–40

Shown in FIGS. 34–37 are sleeves 10*cc*, 10*dd*, 10*ee* and 10*ff* which are essentially the same as sleeves 10, 10*a*, 10*b*, and 10*c*, respectively, except the non-linear upper edges 28*cc*, 28*dd*, 28*ee*, and 28*ff* are irregular, for example, having random peaks and dips.

Figure 38:
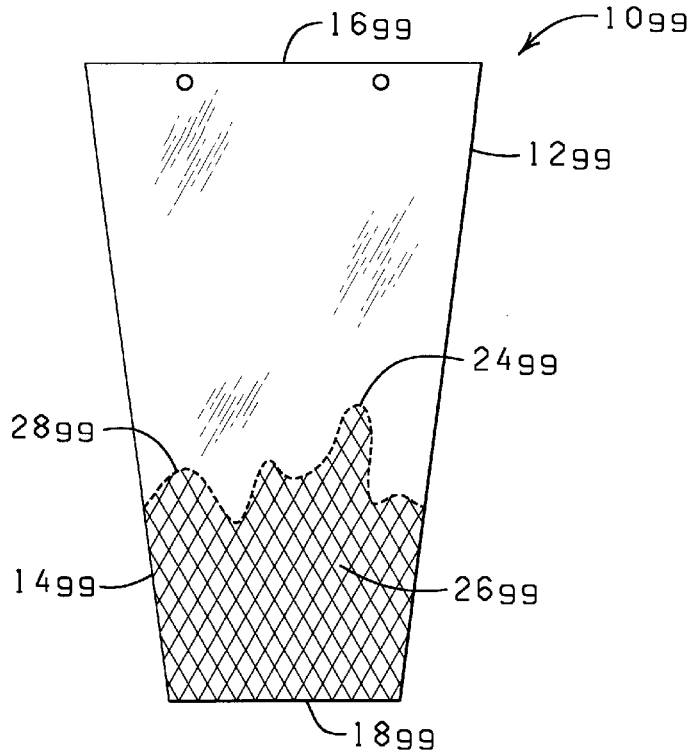
FIG. 38 is an elevational view of another sleeve constructed in accordance with the present invention.
Figure 39:
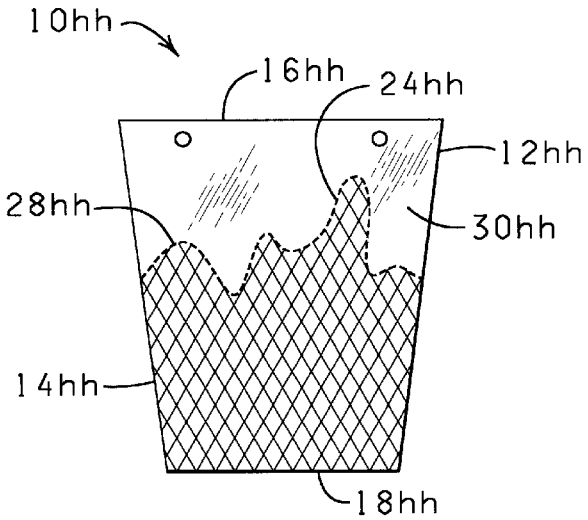
FIG. 39 is an elevational view of another sleeve constructed in accordance with the present invention.
Figure 40:
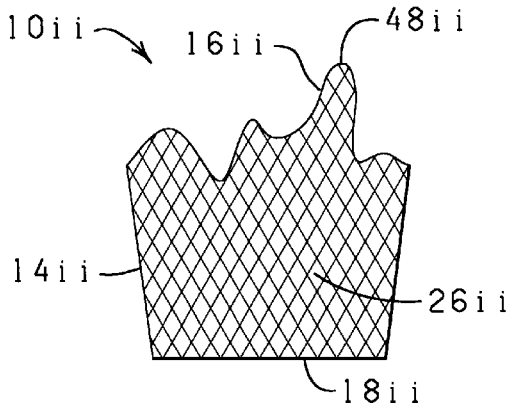
FIG. 40 is an elevational view of another sleeve constructed in accordance with the present invention.

Likewise, sleeves 10*gg*, 10*hh*, and 10*ii*, of FIGS. 38–40, respectively, are like sleeves 10*y*, 10*z*, and 10*aa* of FIGS. 30–32, respectively, except the non-linear upper boundaries 28*gg*, 28*hh*, and 48*ii*, are irregular, for example having random peaks and dips.

It will also be understood that any of the sleeves 10–10*ii* described herein can be used to contain a floral grouping and a growing medium without a pot, wherein the floral grouping is cultivated in the sleeves 10–10*ii*, or placed with a growing medium in the sleeves 10–10*ii* in a substantially grown condition.

Changes may be made in the construction and the operation of the various components, elements and assemblies described herein or in the steps or the sequence of steps of the methods described herein without departing from the spirit and scope of the invention as defined in the following claims.

What is claimed is:

1. A covering for a pot containing a floral grouping, comprising:

a sleeve initially having a flattened condition and comprising:

a lower portion, and an upper portion extending from the lower portion and detachable therefrom via a detaching element, and the lower portion having a bottom having a perimeter when in an opened position, and wherein the lower portion has a decorative pattern which has a non-linear upper boundary comprising a plurality of peaks and troughs, and wherein the detaching element is positioned above the non-linear upper boundary of the decorative pattern, and the lower portion having a clear zone between the non-linear upper boundary of the decorative pattern and the detaching element, and wherein when the upper portion is removed from the lower portion, the lower portion of the sleeve is left with a generally straight upper edge, the lower portion having the appearance of having a non-linear upper edge due to the clear zone between the upper edge and the non-linear upper boundary of the decorative pattern and wherein when the sleeve is in the opened position for receiving the pot therein each peak is a substantially equal first vertical distance from the perimeter of the bottom, and each trough is a substantially equal second vertical distance from the perimeter of the bottom.

2. The sleeve of claim 1 wherein the upper portion is adapted to be used to support the sleeve from a wicket device.

3. The sleeve of claim 1 wherein the detaching element is a line of perforations.

4. The sleeve of claim 1 wherein the upper portion is sized to substantially surround and encompass the floral grouping extending a substantial distance vertically above the pot containing the floral grouping when the sleeve is disposed about said pot.

5. The sleeve of claim 1 wherein the lower portion has a tapered shape sized to fit the pot.

6. The sleeve of claim 1 wherein the upper end of the sleeve has a bonding material thereon for sealing the upper end.

7. The sleeve of claim 1 wherein the sleeve comprises a side gusset and a bottom gusset such that the sleeve in the opened condition conforms to the shape of a pot having a rectangular shape.

8. The sleeve of claim 1 wherein the sleeve has a straight sealed lower end.

9. The sleeve of claim 1 wherein the sleeve has a gusset in the lower end.

10. The sleeve of claim 1 wherein the sleeve comprises a skirt portion which extends at an angle from the lower portion beyond the rim of the pot.

11. The sleeve of claim 1 wherein the sleeve further comprises a bonding material on an inner surface thereof.

* * * * *